US008575278B2

(12) United States Patent
Kim et al.

(10) Patent No.: US 8,575,278 B2
(45) Date of Patent: Nov. 5, 2013

(54) IONOMER COMPOSITIONS FOR GOLF BALLS

(75) Inventors: Hyun J. Kim, Carlsbad, CA (US); Hong G. Jeon, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 303 days.

(21) Appl. No.: 12/974,785

(22) Filed: Dec. 21, 2010

(65) Prior Publication Data

US 2011/0159992 A1 Jun. 30, 2011

Related U.S. Application Data

(60) Provisional application No. 61/291,518, filed on Dec. 31, 2009.

(51) Int. Cl.

| | |
|---|---|
| ***A63B 37/00*** | (2006.01) |
| ***C08C 19/20*** | (2006.01) |
| ***C08L 15/00*** | (2006.01) |

(52) U.S. Cl.

USPC ..... 525/333.1; 525/343; 525/344; 525/353; 473/371; 473/372; 473/373; 473/378; 473/385

(58) Field of Classification Search

None

See application file for complete search history.

(56) References Cited

U.S. PATENT DOCUMENTS

| | | | | |
|---|---|---|---|---|
| 3,264,272 | A | | 8/1966 | Rees et al. |
| 3,265,272 | A | | 8/1966 | Smith |
| 3,359,231 | A | | 12/1967 | George |
| 3,388,186 | A | | 6/1968 | Kray et al. |
| 3,454,280 | A | | 7/1969 | Harrison et al. |
| 3,465,059 | A | | 9/1969 | Seven et al. |
| 3,492,245 | A | | 1/1970 | Calderon et al. |
| 3,528,936 | A | | 9/1970 | Kent et al. |
| 3,560,573 | A | | 2/1971 | Hayden et al. |
| 3,634,543 | A | | 1/1972 | Sherman |
| 3,726,835 | A | | 4/1973 | Bertozzi |
| 3,804,803 | A | | 4/1974 | Streck et al. |
| 3,819,768 | A | | 6/1974 | Molitor |
| 3,974,092 | A | | 8/1976 | Streck et al. |
| 3,974,238 | A | | 8/1976 | Schweiker et al. |
| 3,989,568 | A | | 11/1976 | Isaac |
| 4,035,438 | A | | 7/1977 | Nielinger et al. |
| 4,104,216 | A | | 8/1978 | Clampitt |
| 4,115,437 | A | * | 9/1978 | Matsuda et al. ..... 562/101 |
| 4,115,475 | A | | 9/1978 | Foy et al. |
| 4,123,061 | A | | 10/1978 | Dusbiber |
| 4,153,772 | A | | 5/1979 | Schwesig et al. |
| 4,183,876 | A | | 1/1980 | Coran et al. |
| 4,195,015 | A | | 3/1980 | Deleens et al. |
| 4,217,430 | A | | 8/1980 | Starkweather et al. |
| 4,230,828 | A | | 10/1980 | Caul, Jr. et al. |
| 4,230,838 | A | | 10/1980 | Foy et al. |
| 4,248,432 | A | | 2/1981 | Hewitt et al. |
| 4,331,786 | A | | 5/1982 | Foy et al. |
| 4,332,920 | A | | 6/1982 | Foy et al. |
| 4,349,657 | A | | 9/1982 | Halloway |
| 4,404,325 | A | | 9/1983 | Mason et al. |
| 4,431,193 | A | | 2/1984 | Nesbitt |
| 4,482,663 | A | | 11/1984 | Kraus |
| 4,546,980 | A | | 10/1985 | Gendreau et al. |
| 4,611,810 | A | | 9/1986 | Kamata et al. |
| 4,692,497 | A | | 9/1987 | Gendreau et al. |
| 4,726,590 | A | | 2/1988 | Molitor |
| 4,728,693 | A | | 3/1988 | Dröscher et al. |
| 4,755,552 | A | | 7/1988 | Jadamus et al. |
| 4,762,322 | A | | 8/1988 | Molitor et al. |
| 4,781,383 | A | | 11/1988 | Kamada et al. |
| 4,792,141 | A | | 12/1988 | Llort |
| 4,798,386 | A | | 1/1989 | Berard |
| 4,838,556 | A | | 6/1989 | Sullivan |

(Continued)

FOREIGN PATENT DOCUMENTS

| | | |
|---|---|---|
| EP | 0 342 244 | 11/1989 |
| EP | 0 577 058 | 1/1994 |

(Continued)

OTHER PUBLICATIONS

Boochathum; Vulcanization of cis and trans-polyisoprene and their blends; European Polymer Journal 37 (2001) pp. 429-434.*

Akrochem Proaid AC 18E product literature (no date).

DeStefani, "Small but Mighty," *Molding Systems* 3:34-46, Oct. 1999.

DuPont Packaging & Industrial Polymers, DuPont™ Surlyn® 8150 Data Sheet (3 pages), E.I. DuPont De Nemours and Company, Inc., Mar. 2004.

DuPont Packaging & Industrial Polymers, DuPont™ Surlyn® 9150 Data Sheet (3 pages), E.I. DuPont De Nemours and Company, Inc., Mar. 2004.

DuPont Product Literature for HPF1000, May 2005.

DuPont Product Literature for HPF2000, May 2005.

(Continued)

*Primary Examiner* — David Buttner

(74) *Attorney, Agent, or Firm* — Klarquist Sparkman, LLP

(57) ABSTRACT

Certain disclosed embodiments of the present invention concern a golf ball including a core having a center, an outer cover layer, and optionally one or more intermediate layers. At least one or more of the core, outer cover layer or one or more intermediate layers includes a sulfonated polyisoprene ionomer having the general formula:

where A is an isoprene repeating unit having the formula —($CH_2$—C($CH_3$)=CH—$CH_2$)—, B is an isoprene repeating unit or other monomer repeating unit, m is greater than 10, and n is greater than 2, and X is selected from one or both of the following groups; i) $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$ or ii) an ammonium cation having the general formula $[NR^1R^2R^3R^4]^+$. $R^1$, $R^2$, $R^3$ and $R^4$ are selected from one or both of the following hydrogen, a $C_1$-$C_{20}$ aliphatic, cycloaliphatic or aromatic moiety.

19 Claims, 2 Drawing Sheets

(56) References Cited

U.S. PATENT DOCUMENTS 4,839,441 A 6/1989 Cuzin et al.
4,840,993 A 6/1989 Bartz
4,844,471 A 7/1989 Terence et al.
4,852,884 A 8/1989 Sullivan
4,864,014 A 9/1989 Cuzin et al.
4,865,326 A 9/1989 Isaac et al.
4,884,814 A 12/1989 Sullivan
4,894,411 A 1/1990 Okada et al.
4,950,826 A 8/1990 Zerpner et al.
4,955,966 A 9/1990 Yuki
4,998,734 A 3/1991 Meyer
5,007,647 A 4/1991 Gulick
5,064,199 A 11/1991 Morell
5,130,372 A 7/1992 Lences et al.
5,150,905 A 9/1992 Yuki et al.
5,228,697 A 7/1993 Gulick et al.
5,252,652 A 10/1993 Egashira et al.
5,253,871 A 10/1993 Viollaz
5,301,951 A 4/1994 Morell
5,306,760 A 4/1994 Sullivan
5,312,857 A 5/1994 Sullivan
5,324,783 A 6/1994 Sullivan
5,330,195 A 7/1994 Gulick
5,334,673 A 8/1994 Wu
5,384,385 A 1/1995 Trinks et al.
5,385,776 A 1/1995 Maxfield et al.
5,424,006 A 6/1995 Murayama et al.
5,436,295 A 7/1995 Nishikawa et al.
5,460,367 A 10/1995 Horiuchi
5,484,870 A 1/1996 Wu
5,496,035 A 3/1996 Gilchrist et al.
5,542,680 A 8/1996 Proudfit et al.
5,609,535 A 3/1997 Morgan
5,651,741 A 7/1997 Masutani et al.
5,679,745 A * 10/1997 Hamada et al. ..... 525/195
5,688,869 A 11/1997 Sullivan
5,691,066 A 11/1997 Rajagopalan
5,692,974 A 12/1997 Wu et al.
5,733,205 A 3/1998 Higuchi et al.
5,766,097 A 6/1998 Horiuchi et al.
5,776,012 A 7/1998 Moriyama et al.
5,779,561 A 7/1998 Sullivan et al.
5,789,475 A 8/1998 Chen
5,810,677 A 9/1998 Maruko et al.
5,810,678 A 9/1998 Cavallaro et al.
5,816,943 A 10/1998 Masutani et al.
5,833,553 A 11/1998 Sullivan et al.
5,886,103 A 3/1999 Bellinger et al.
5,948,862 A 9/1999 Sano et al.
5,959,059 A 9/1999 Vedula et al.
5,962,533 A 10/1999 Bergeron, Jr.
5,962,553 A 10/1999 Ellsworth
5,973,046 A 10/1999 Chen et al.
5,985,370 A 11/1999 Ohira et al.
5,989,135 A 11/1999 Welch
5,989,136 A 11/1999 Renard et al.
6,012,991 A 1/2000 Kim et al.
6,012,992 A 1/2000 Yavitz
6,037,419 A 3/2000 Takesue et al.
6,042,489 A 3/2000 Renard et al.
6,060,549 A 5/2000 Li et al.
6,068,561 A 5/2000 Renrad et al.
6,083,119 A 7/2000 Sullivan et al.
6,100,321 A 8/2000 Chen
6,117,024 A 9/2000 Dewanjee
6,117,025 A 9/2000 Sullivan
6,142,887 A 11/2000 Sullivan et al.
6,162,135 A 12/2000 Bulpett et al.
6,180,722 B1 1/2001 Dalton et al.
6,183,382 B1 2/2001 Kim et al.
6,193,617 B1 2/2001 Mertens
6,203,451 B1 3/2001 Rajagopalan
6,245,862 B1 * 6/2001 Rajagopalan ..... 525/340
6,255,361 B1 7/2001 Rajagopalan et al.
6,309,706 B2 10/2001 Maruoka et al.
6,315,681 B1 11/2001 Sullivan
6,329,458 B1 12/2001 Takesue et al.
6,361,455 B1 3/2002 Takemura
6,368,237 B1 4/2002 Sullivan
6,416,424 B2 7/2002 Sullivan
6,419,594 B1 7/2002 Nesbitt et al.
6,426,387 B1 7/2002 Kim
6,435,986 B1 8/2002 Wu et al.
6,454,666 B1 9/2002 Shira
6,462,303 B1 10/2002 Brown
6,476,176 B1 11/2002 Wu
6,485,378 B1 11/2002 Boehm
6,503,156 B1 1/2003 Sullivan
6,506,130 B2 1/2003 Sullivan
6,508,724 B2 1/2003 Dalton
6,508,725 B1 1/2003 Kim
6,520,871 B1 2/2003 Sullivan et al.
6,525,157 B2 2/2003 Cozewith et al.
6,537,158 B2 3/2003 Watanabe
6,558,277 B1 5/2003 Ohira et al.
6,562,906 B2 5/2003 Chen
6,569,037 B2 5/2003 Ichikawa et al.
6,582,326 B2 6/2003 Wu et al.
6,592,472 B2 7/2003 Dewanjee
6,610,812 B1 8/2003 Wu et al.
6,616,552 B2 9/2003 Takesue et al.
6,635,715 B1 10/2003 Datta et al.
6,635,716 B2 10/2003 Voorheis et al.
6,639,024 B2 10/2003 Simonds et al.
6,642,316 B1 11/2003 Datta et al.
6,649,678 B1 11/2003 Sandstrom
6,653,382 B1 11/2003 Statz et al.
6,653,403 B2 11/2003 Dalton et al.
6,692,379 B2 2/2004 Morgan et al.
6,695,718 B2 2/2004 Nesbitt
6,719,646 B2 4/2004 Calabria et al.
6,762,244 B2 7/2004 Rajagopalan et al.
6,762,273 B2 7/2004 Dewanjee
6,770,360 B2 8/2004 Mientus et al.
6,776,942 B2 8/2004 Kim
6,777,472 B1 8/2004 Statz et al.
6,780,126 B2 8/2004 Ladd et al.
6,780,127 B2 8/2004 Kennedy, III
6,793,864 B1 9/2004 Dewanjee et al.
6,794,447 B1 9/2004 Kim et al.
6,812,276 B2 11/2004 Yeager
6,815,480 B2 11/2004 Statz et al.
6,835,146 B2 12/2004 Jordan et al.
6,852,784 B2 2/2005 Sullivan
6,861,474 B2 3/2005 Kim
6,878,075 B2 4/2005 Kim
6,894,098 B2 5/2005 Rajagopalan et al.
6,903,178 B2 6/2005 Wu et al.
6,905,423 B2 6/2005 Morgan et al.
6,919,395 B2 7/2005 Rajagopalan et al.
6,924,337 B2 8/2005 Kim et al.
6,930,150 B2 8/2005 Kim
6,939,924 B2 9/2005 Kim et al.
6,949,595 B2 9/2005 Morgan et al.
6,951,519 B2 10/2005 Dewanjee et al.
6,960,629 B2 11/2005 Voorheis et al.
6,962,951 B1 11/2005 Takesue et al.
6,974,854 B2 12/2005 Dewanjee
7,001,286 B2 2/2006 Kim et al.
7,026,399 B2 4/2006 Kim et al.
7,037,985 B2 5/2006 Kim et al.
7,041,769 B2 5/2006 Wu et al.
7,070,518 B2 7/2006 Kennedy, III
7,163,471 B2 1/2007 Kim et al.
7,169,861 B2 1/2007 Kim et al.
7,182,703 B2 2/2007 Emerson et al.
7,208,546 B2 4/2007 Rajagopalan et al.
7,226,961 B2 6/2007 Park et al.
7,230,127 B2 6/2007 Sage et al.
7,242,443 B2 7/2007 Sage et al.
7,261,647 B2 8/2007 Sullivan et al.
7,265,195 B2 9/2007 Kuntimaddi et al.
7,276,570 B2 10/2007 Kuntimaddi et al.
7,314,896 B2 1/2008 Rajagopalan et al.

(56) References Cited

U.S. PATENT DOCUMENTS

| | | | |
|---|---|---|---|
| 7,332,533 | B2 | 2/2008 | Kim et al. |
| 7,378,483 | B2 | 5/2008 | Wu et al. |
| 7,462,113 | B2 | 12/2008 | Kim et al. |
| 7,491,136 | B2 | 2/2009 | Deng et al. |
| 7,528,196 | B2 | 5/2009 | Kim et al. |
| 7,534,838 | B2 | 5/2009 | Kim et al. |
| 7,687,116 | B2 | 3/2010 | Kim et al. |
| 7,767,759 | B2 | 8/2010 | Kim |
| 7,874,940 | B2 | 1/2011 | Kim et al. |
| 7,878,926 | B2 | 2/2011 | Kim et al. |
| 8,030,411 | B2 | 10/2011 | Kim et al. |
| 2001/0005699 | A1 | 6/2001 | Morgan et al. |
| 2001/0019971 | A1 | 9/2001 | Hayashi et al. |
| 2001/0031669 | A1 | 10/2001 | Ohama |
| 2001/0046906 | A1 | 11/2001 | Rajagopalan et al. |
| 2002/0040111 | A1 | 4/2002 | Rajagopalan |
| 2002/0045499 | A1 | 4/2002 | Takemura et al. |
| 2002/0049099 | A1 | 4/2002 | Peter |
| 2002/0061792 | A1 | 5/2002 | Yagley et al. |
| 2002/0065149 | A1 | 5/2002 | Tzivanis et al. |
| 2002/0193181 | A1 | 12/2002 | Kennedy et al. |
| 2003/0008975 | A1 | 1/2003 | Takesue et al. |
| 2003/0012902 | A1 | 1/2003 | Kim et al. |
| 2003/0017888 | A1 | 1/2003 | Higuchi et al. |
| 2003/0050373 | A1 | 3/2003 | Chen |
| 2003/0060307 | A1 | 3/2003 | Umezawa et al. |
| 2003/0064826 | A1 | 4/2003 | Voorheis et al. |
| 2003/0069087 | A1 | 4/2003 | Ichikawa et al. |
| 2003/0078348 | A1 | 4/2003 | Rajagopalan et al. |
| 2003/0096661 | A1 | 5/2003 | Kim |
| 2003/0119989 | A1 | 6/2003 | Ladd et al. |
| 2003/0130066 | A1 | 7/2003 | Saski |
| 2003/0158312 | A1 | 8/2003 | Chen |
| 2003/0224871 | A1 | 12/2003 | Kim et al. |
| 2003/0228937 | A1 | 12/2003 | Dewanjee |
| 2003/0229183 | A1 | 12/2003 | Voorheis et al. |
| 2004/0019138 | A1 | 1/2004 | Voorheis et al. |
| 2004/0044136 | A1 | 3/2004 | Kim et al. |
| 2004/0059062 | A1 | 3/2004 | Kim |
| 2004/0082408 | A1 | 4/2004 | Sullivan et al. |
| 2004/0092336 | A1 | 5/2004 | Kim et al. |
| 2004/0097653 | A1 | 5/2004 | Kim et al. |
| 2004/0106474 | A1 | 6/2004 | Hayashi et al. |
| 2004/0161623 | A1 | 8/2004 | Domine et al. |
| 2004/0176185 | A1 | 9/2004 | Morgan et al. |
| 2004/0176188 | A1 | 9/2004 | Morgan et al. |
| 2004/0180733 | A1 | 9/2004 | Kim |
| 2004/0201133 | A1 | 10/2004 | Dewanjee et al. |
| 2004/0209708 | A1 | 10/2004 | Bulpett et al. |
| 2004/0230005 | A1 | 11/2004 | Voorheis et al. |
| 2004/0230006 | A1 | 11/2004 | Voorheis et al. |
| 2004/0230007 | A1 | 11/2004 | Voorheis et al. |
| 2004/0233347 | A1 | 11/2004 | Sage et al. |
| 2004/0235584 | A1 | 11/2004 | Chao et al. |
| 2004/0236030 | A1 | 11/2004 | Kim et al. |
| 2004/0245503 | A1 | 12/2004 | Sage et al. |
| 2004/0248669 | A1 | 12/2004 | Kim et al. |
| 2004/0248670 | A1 | 12/2004 | Okamoto et al. |
| 2004/0248671 | A1 | 12/2004 | Kim et al. |
| 2004/0248672 | A1 | 12/2004 | Jeon et al. |
| 2004/0254298 | A1 | 12/2004 | Kim et al. |
| 2004/0266553 | A1 | 12/2004 | Park et al. |
| 2004/0266554 | A1 | 12/2004 | Park et al. |
| 2004/0266555 | A1 | 12/2004 | Park et al. |
| 2005/0020385 | A1 | 1/2005 | Onoda et al. |
| 2005/0026718 | A1 | 2/2005 | Chen |
| 2005/0037870 | A1 | 2/2005 | Sullivan et al. |
| 2005/0059756 | A1 | 3/2005 | Kim et al. |
| 2005/0075196 | A1 | 4/2005 | Shimizu et al. |
| 2005/0148409 | A1 | 7/2005 | Morgan et al. |
| 2005/0148725 | A1 | 7/2005 | Statz et al. |
| 2005/0197211 | A1 | 9/2005 | Sullivan et al. |
| 2005/0197464 | A1 | 9/2005 | Handlin, Jr. |
| 2005/0197465 | A1 | 9/2005 | Handlin, Jr. |
| 2005/0215963 | A1 | 9/2005 | Autran et al. |
| 2005/0215964 | A1 | 9/2005 | Autran et al. |
| 2005/0239575 | A1 | 10/2005 | Chao et al. |
| 2005/0244638 | A1 | 11/2005 | Chang et al. |
| 2005/0245652 | A1 | 11/2005 | Bulpett et al. |
| 2005/0250601 | A1 | 11/2005 | Kim et al. |
| 2005/0256276 | A1 | 11/2005 | Elkin et al. |
| 2005/0261424 | A1 | 11/2005 | Snell et al. |
| 2005/0288446 | A1 | 12/2005 | Zieske et al. |
| 2006/0014898 | A1 | 1/2006 | Kim |
| 2006/0030427 | A1 | 2/2006 | Kim et al. |
| 2006/0166761 | A1 | 7/2006 | Kim et al. |
| 2006/0166762 | A1 | 7/2006 | Kim et al. |
| 2006/0172823 | A1 | 8/2006 | Loper et al. |
| 2006/0247074 | A1 | 11/2006 | Kim et al. |
| 2007/0015605 | A1 | 1/2007 | Kim et al. |
| 2007/0054754 | A1 | 3/2007 | Kim et al. |
| 2007/0100085 | A1 | 5/2007 | Kim et al. |
| 2007/0142568 | A1 | 6/2007 | Kim et al. |
| 2007/0213144 | A1 | 9/2007 | Comeau et al. |
| 2007/0232756 | A1 | 10/2007 | Kim et al. |
| 2007/0238552 | A1 | 10/2007 | Kim et al. |
| 2007/0243954 | A1 | 10/2007 | Sullivan et al. |
| 2008/0009371 | A1 | 1/2008 | Mayer, Jr. |
| 2008/0090678 | A1 | 4/2008 | Kim et al. |
| 2008/0139334 | A1 | 6/2008 | Willett et al. |
| 2008/0146374 | A1 | 6/2008 | Beach et al. |
| 2008/0176677 | A1 | 7/2008 | Snell et al. |
| 2008/0214326 | A1 | 9/2008 | Kim et al. |
| 2008/0274825 | A1 | 11/2008 | Kim et al. |
| 2009/0023518 | A1 | 1/2009 | Kim et al. |
| 2009/0163298 | A1 | 6/2009 | Kim |
| 2009/0166924 | A1 | 7/2009 | Kuttappa |
| 2009/0170634 | A1 | 7/2009 | Loper et al. |
| 2009/0176601 | A1 | 7/2009 | Snell et al. |
| 2009/0191981 | A1 | 7/2009 | Kim et al. |
| 2010/0160081 | A1 | 6/2010 | Kim et al. |
| 2010/0179002 | A1 | 7/2010 | Kim et al. |
| 2012/0040776 | A1 | 2/2012 | Kim et al. |

FOREIGN PATENT DOCUMENTS

| | | |
|---|---|---|
| EP | 0 601 861 | 6/1994 |
| GB | 2 278 609 | 12/1994 |
| GB | 2 320 439 | 6/1998 |
| JP | 59157122 | 9/1984 |
| JP | 60249980 | 12/1985 |
| JP | 62267357 | 11/1987 |
| JP | 63221157 | 9/1988 |
| JP | 02092379 | 4/1990 |
| JP | 04001231 | 1/1992 |
| JP | 5007635 | 1/1993 |
| JP | 6313075 | 11/1994 |
| JP | 08103516 | * 4/1996 |
| JP | 9227737 | 9/1997 |
| JP | 10127822 | 5/1998 |
| JP | 10137364 | 5/1998 |
| JP | 10231400 | 9/1998 |
| JP | 11299933 | 11/1999 |
| JP | 2000-005341 | 1/2000 |
| JP | 2000-060999 | 2/2000 |
| JP | 2000-061001 | 2/2000 |
| JP | 2000-070409 | 3/2000 |
| JP | 2000-070412 | 3/2000 |
| JP | 2000-070414 | 3/2000 |
| JP | 2000070411 | 3/2000 |
| JP | 2001-218872 | 8/2001 |
| JP | 2002-065896 | 3/2002 |
| JP | 2003-339910 | 12/2003 |
| JP | 2005-066040 | 3/2005 |
| JP | 2005-137743 | 6/2005 |
| WO | WO 93/11190 | 6/1993 |
| WO | WO 96/40378 | 12/1996 |
| WO | WO 98/43709 | 10/1998 |
| WO | WO 99/20354 | 4/1999 |
| WO | WO 99/54001 | 10/1999 |
| WO | WO 00/41773 | 7/2000 |
| WO | WO 00/57962 | 10/2000 |
| WO | WO 02/09823 | 2/2002 |
| WO | WO 02/062914 | 8/2002 |

(56) References Cited

FOREIGN PATENT DOCUMENTS

OTHER PUBLICATIONS

DuPont™ Surlyn® molding resins for golf ball manufacturing, Golf Ball Resins, http://www2.dupont.com/Surlyn/en_US/products/golfball_resins.html, downloaded Dec. 27, 2007.
*Encyclopedia of Chemical Technology* 6:415-418, 1993.
*Encyclopedia of Polymer Science and Engineering* 7:54-55, 1988.
*Hawley's Condensed Chemical Dictionary*, 13th edition, pp. 206, 828, 2001.
http://www.chemsoc.org/chembytes/ezine/2002/birkitt_july02.htm (accessed Nov. 1, 2006).
http://bppetrochemicals.com (accessed Nov. 1, 2006) (http://bp.com/modularhome.do?categoryId=-6110).
http://www.nml.csir.co.za/news/20020711/index1.htm (accessed May 29, 2007).
http://www3.interscience.wiley.com/cgi-bin/abstract/70000886/ABSTRACT (accessed May 29, 2007).
Research Disclosure 29703, E.I. DuPont de Nemours & Co., 2 pages, published Jan. 1989.
Rostek et al., "Novel Sulfur Vulcanization Accelerators Based on Mercapto-Pyridine, -Pyrazine, and -Pyrimidine," *Rubber and Chemistry Technology* 69(2):180-202, 1996.
Saunders, "Polyurethanes Chemistry and Technology Part I," pp. 32-43, 1962.
Schuler et al., "Fate of Erucamide in Polyolefin Films at Elevated Temperature," *Polym. Eng. Sci*. 44:2247-2253, 2004.
Sherman, "Close-Up on Technology—TP Elastomers—New Metallocene TP Elastomers Tackle Films, Fibers, TPOs," *Plastics Technology Online Article*, http://www.plasticstechnology.com/articles/200310cu2.html, downloaded Dec. 5, 2005.
Technical Data, *General Information about Nanomers, Nanocor*, 2 pages (No Date).
Thain, *Science and Golf IV*, pp. 319-327, Jul. 2002.
English Translation of Notice of Reasons for Rejection dispatched from the Japanese Patent Office on Jan. 16, 2008, in Japanese Application No. 2006-014614.
English Translation of Notice of Reasons for Rejection, dispatched from the Japanese Patent Office on Oct. 22, 2008, in Japanese Application No. 2006-014614.
Office Action dated Nov. 25, 2009 from U.S. Appl. No. 11/428,278.

* cited by examiner

IONOMER COMPOSITIONS FOR GOLF BALLS

CROSS REFERENCE TO RELATED APPLICATION

This application claims the benefit of the earlier filing date of U.S. Provisional Application No. 61/291,518, filed on Dec. 31, 2009, which is incorporated herein by reference.

FIELD

The present invention relates to golf balls prepared from a sulfonated polyisoprene ionomer ("SPI"). In one embodiment, the SPI is used in the manufacture of a golf ball core. In another embodiment, a golf ball is disclosed in which the SPI is used in the manufacture of a golf ball outer cover layer. In another embodiment, a golf ball is disclosed in which the SPI is used in the manufacture of at least one intermediate layer of a golf ball. In another embodiment, a golf ball is disclosed in which the SPI is used in the manufacture of at least two golf ball components, such as a core and an outer cover layer and/or an intermediate layer, or an intermediate layer and an outer cover layer.

DESCRIPTION OF RELATED ART

The application of synthetic polymer chemistry to the field of sports equipment has revolutionized the performance of athletes in many sports. One sport in which this is particularly true is golf, especially as relates to advances in golf ball performance and ease of manufacture. For instance, the earliest golf balls consisted of a leather cover filled with wet feathers. These "feathery" golf balls were subsequently replaced with a single piece golf ball made from "gutta percha," a naturally occurring rubber-like material. In the early 1900's, the wound rubber ball was introduced, consisting of a solid rubber core around which rubber thread was tightly wound with a gutta percha cover.

More modern golf balls can be classified as one-piece, two-piece, three-piece or multi-layered golf balls. One-piece balls are molded from a homogeneous mass of material with a dimple pattern molded thereon. One-piece balls are inexpensive and very durable, but do not provide great distance because of relatively high spin and low velocity. Two-piece balls are made by molding a cover around a solid rubber core. These are the most popular types of balls in use today. In attempts to further modify the ball performance especially in terms of the distance such balls travel and the feel transmitted to the golfer through the club on striking the ball, the basic two piece ball construction has been further modified by the introduction of additional layers between the core and outer cover layer. If one additional layer is introduced between the core and outer cover layer a so called "three-piece ball" results and similarly, if two additional layers are introduced between the core and outer cover layer, a so called "four-piece ball" results, and so on.

Golf ball covers were previously made from balata rubber, which was favored by some players because the softness of the cover allows them to achieve spin rates sufficient to allow more precisely control of ball direction and distance, particularly on shorter approach shots. However balata-covered balls, although exhibiting high spin and soft feel, were often deficient in terms of the velocity of the ball when it leaves the club face which in turn affects the distance the ball travels.

Accordingly, a variety of golf ball constructions have been developed in an attempt to provide spin rates and a feel approaching those of balata covered balls, while also providing a golf ball with a higher durability and overall distance. This has resulted in the emergence of balls, which have a solid rubber core, a cover, and one, or more so called intermediate layers, as well as the application of new materials to each of these components.

A material which has been often utilized in more modern golf balls is the family of ionomer resins developed in the mid-1960's, by E.I. DuPont de Nemours and Co., and sold under the trademark SURLYN®. These ionomer resins have, to a large extent, replaced balata as a golf ball cover stock material. Preparation of such ionomers is well known, for example see U.S. Pat. No. 3,264,272 (the entire contents of which are herein incorporated by reference). Generally speaking, commercial ionomers used in golf balls consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer." The acid groups in the polymer are then neutralized to varying degrees by addition of a neutralizing agent in the form of a basic metal salt. Today, there are a wide variety of commercially available ionomer resins based both on copolymers of ethylene and (meth) acrylic acid or terpolymers of ethylene and (meth)acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization.

More recent developments in the field have attempted to utilize the various types of ionomers, both singly and in blend compositions to optimize the often conflicting golf ball performance requirements of high C.O.R. and ball velocity, and cover durability, with the need for a ball to spin and have a so-called soft feel on shorter iron shots. However, the incorporation of more acid in the ionomer and/or increasing its degree of neutralization results in a material with increased polarity, and hence one which is often less compatible with other potential blend materials. Also increasing the acid content of the ionomer while increasing C.O.R. may render the ball too hard and brittle causing a loss of shot feel, control (i.e., the ability to spin the ball) and may render the cover too brittle and prone to premature failure. Finally, the incorporation of more acid in the ionomer and/or increasing its degree of neutralization typically results in an increase in melt viscosity which in turn greatly decreases the processability of these resins. Attempts to mediate these effects by adding softer terpolymeric ionomers to high acid ionomer compositions to adjust the hardness and improve the shot "feel" often result in concomitant loss of C.O.R. and hence distance.

SUMMARY

Thus, there remains a need for new materials with equivalent or improved properties to the available ionomer resins for use in golf ball manufacture. The present invention relates to golf balls and golf ball components comprising a sulfonated polyisoprene ionomer ("SPI"). These compositions may be used directly or prepared from the corresponding sulfonic acid-substituted polyisoprene mixed with one or more basic metal or non-metal salts capable of neutralizing the acid groups in the polymer.

Certain disclosed embodiments of the present invention concern a golf ball comprising a core having a center, an outer cover layer, and optionally one or more intermediate layers.

At least one or more of the core, outer cover layer or one or more intermediate layers includes a sulfonated polyisoprene ionomer having the general formula:

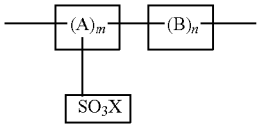

where A is an isoprene repeating unit having the formula —($CH_2$—C($CH_3$)═CH—$CH_2$)—, B is an isoprene repeating unit or other monomer repeating unit, m is greater than 10, n is greater than 2, and X is selected from one or both of the following groups: i) $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$ or ii) an ammonium cation having the general formula $[NR^1R^2R^3R^4]^+$ where $R^1$, $R^2$, $R^3$ and $R^4$ are selected from one or both of the following hydrogen, a $C_1$-$C_{20}$ aliphatic, cycloaliphatic or aromatic moiety.

BRIEF DESCRIPTION OF DRAWINGS

Although FIGS. 1 and 2 illustrate only three- and four-piece golf ball constructions, golf balls of the present invention may comprise from 1 to at least 5 intermediate layer(s), preferably from 1 to 3 intermediate layer(s), more preferably from 1 to 2 intermediate layer(s).

DETAILED DESCRIPTION

I. Definitions

Figure 1:
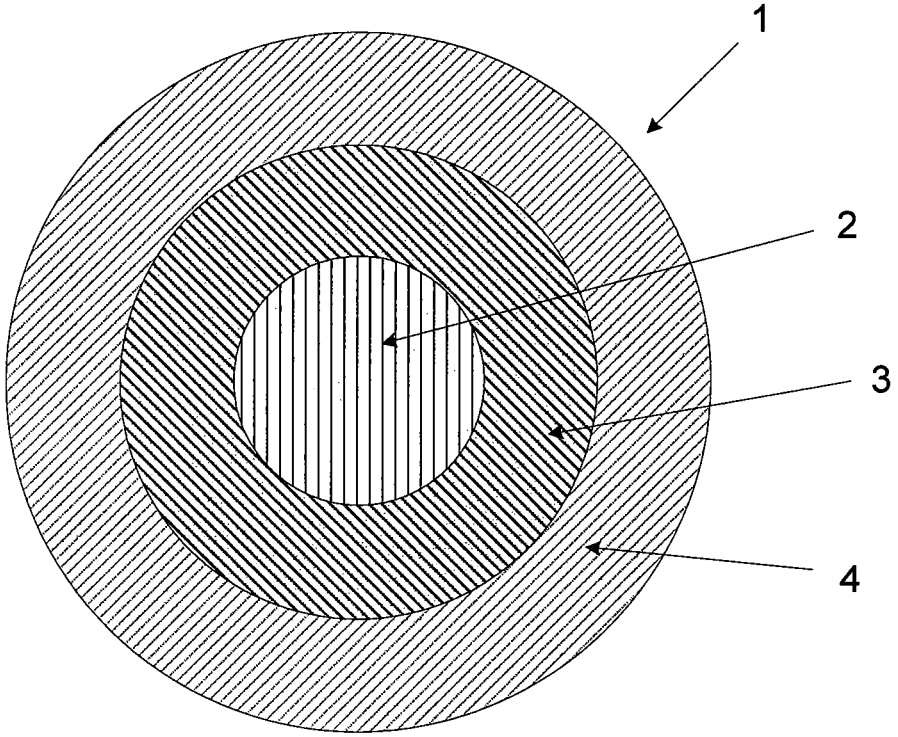
FIG. 1 illustrates a three-piece golf ball 1 comprising a solid center or core 2, an intermediate layer 3, and an outer cover layer 4.
Figure 2:
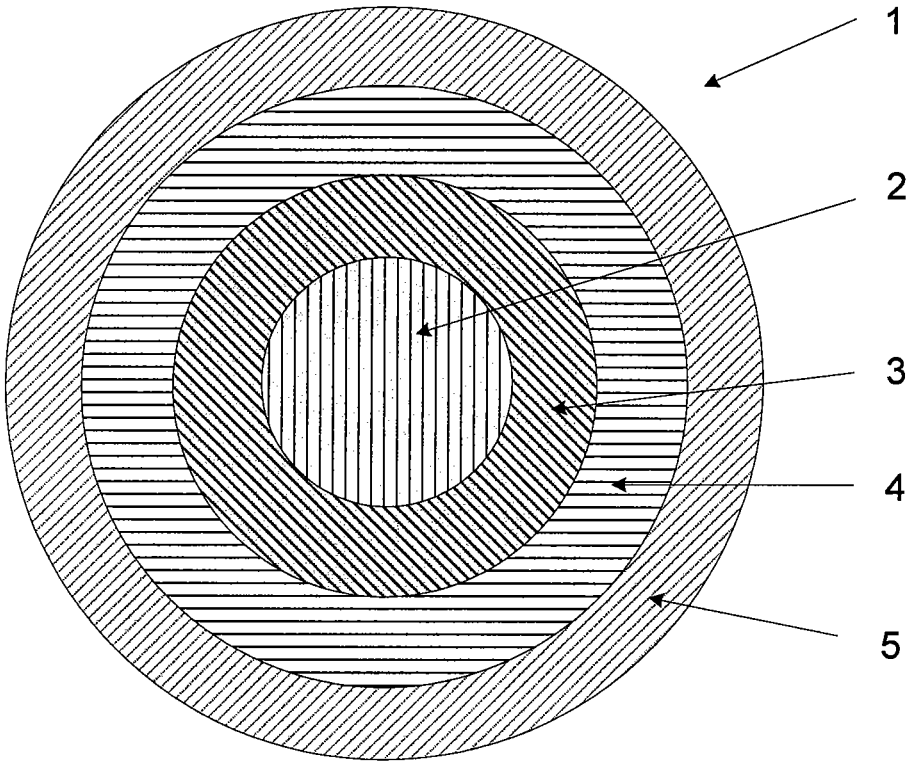
FIG. 2 illustrates a 4-piece golf ball 1 comprising a core 2, an outer cover layer 5, an inner intermediate layer 3, and an outer intermediate layer 4.

Any numerical values recited herein include all values from the lower value to the upper value in increments of one unit provided that there is a separation of at least 2 units between any lower value and any higher value. As an example, if it is stated that the amount of a component or a value of a process variable is from 1 to 90, preferably from 20 to 80, more preferably from 30 to 70, it is intended that values such as 15 to 85, 22 to 68, 43 to 51, 30 to 32 etc. are expressly enumerated in this specification. For values, which have less than one unit difference, one unit is considered to be 0.1, 0.01, 0.001, or 0.0001 as appropriate. Thus all possible combinations of numerical values between the lowest value and the highest value enumerated herein are said to be expressly stated in this application.

The term "(meth)acrylic acid copolymers" is intended to mean copolymers of methacrylic acid and/or acrylic acid.

The term "(meth)acrylate" is intended to mean an ester of methacrylic acid and/or acrylic acid.

The term "aliphatic" is intended to mean any open or closed chain molecule, excluding aromatic compounds, containing only carbon and hydrogen atoms which are joined by single bonds (alkanes), double bonds (alkenes), or triple bonds (alkynes). This term encompasses substituted aliphatic compounds, saturated aliphatic compounds, and unsaturated aliphatic compounds.

The terms "aromatic" and "aryl" refer to a substantially hydrocarbon-based aromatic compound, or a radical thereof (e.g. C6H5) as a substituent bonded to another group, particularly other organic groups, having a ring structure as exemplified by benzene, naphthalene, phenanthrene, anthracene, etc.

The terms "alicyclic" and "cycloaliphatic" refer to aliphatic compounds wherein carbon atoms are connected in a ring instead of a chain.

The term "partially neutralized" is intended to mean an ionomer with a degree of neutralization of less than 100 percent.

The term "hydrocarbyl" is intended to mean any aliphatic, cycloaliphatic, aromatic, aryl substituted aliphatic, aryl substituted cycloaliphatic, aliphatic substituted aromatic, or cycloaliphatic substituted aromatic groups. The aliphatic or cycloaliphatic groups are preferably saturated. Likewise, the term "hydrocarbyloxy" means a hydrocarbyl group having an oxygen linkage between it and the carbon atom to which it is attached.

As used herein, the term "core" is intended to mean the elastic center of a golf ball. The core may have one or more "core layers" of elastic material, which are usually made of rubbery material such as diene rubbers.

The term "cover layer" is intended to mean the outermost layer of the golf ball; this is the layer that is directly in contact with paint and/or ink on the surface of the golf ball. If the cover consists of two or more layers, only the outermost layer is designated the cover layer, and the remaining layers (excluding the outermost layer) are commonly designated intermediate layers as herein defined. The term "outer cover layer" as used herein is used interchangeably with the term "cover layer."

The term "intermediate layer" may be used interchangeably herein with the terms "mantle layer" or "inner cover layer" and is intended to mean any layer(s) in a golf ball disposed between the core and the outer cover layer. Should a ball have more than one intermediate layer, these may be distinguished as "inner intermediate" or "inner mantle" layers, which are used interchangeably to refer to the intermediate layer nearer the core and further from the outer cover, as opposed to the "outer intermediate" or "outer mantle" layer, which are also used interchangeably to refer to the intermediate layer further from the core and closer to the outer cover.

The term "isoprene" as used herein is interchangeable with the term isoterpene or the chemical name 2-methyl-1,3-butadiene and is a common organic compound with the formula $CH_2$═C($CH_3$)CH═$CH_2$.

The term "prepolymer" as used herein is intended to mean any material that can be further processed to form a final polymer material of a manufactured golf ball, such as, by way of example and not limitation, a polymerized or partially polymerized material that can undergo additional processing, such as crosslinking.

A "thermoplastic" as used herein is intended to mean a material that is capable of softening or melting when heated and of hardening again when cooled. Thermoplastic polymer chains often are not cross-linked or are lightly crosslinked using a chain extender, but the term "thermoplastic" as used herein may refer to materials that initially act as thermoplastics, such as during an initial extrusion process or injection molding process, but which also may be crosslinked, such as during a compression molding step to form a final structure.

A "thermoset" as used herein is intended to mean a material that crosslinks or cures via interaction with as crosslinking or curing agent. Crosslinking may be induced by energy, such as heat (generally above 200° C.), through a chemical reaction (by reaction with a curing agent), or by irradiation. The resulting composition remains rigid when set, and does not soften with heating. Thermosets have this property because the longchain polymer molecules cross-link with each other to give a rigid structure. A thermoset material cannot be melted and re-molded after it is cured. Thus thermosets do not lend themselves to recycling unlike thermoplastics, which can be melted and re-molded.

The term "thermoplastic polyurethane" as used herein is intended to mean a material prepared by reaction of a diisocyanate with a polyol, and optionally addition of a chain extender.

The term "thermoplastic polyurea" as used herein is intended to mean a material prepared by reaction of a diisocyanate with a polyamine, with optionally addition of a chain extender.

The term "thermoset polyurethane" as used herein is intended to mean a material prepared by reaction of a diisocyanate with a polyol, and a curing agent.

The term "thermoset polyurea" as used herein is intended to mean a material prepared by reaction of a diisocyanate with a polyamine, and a curing agent.

A "urethane prepolymer" as used herein is intended to mean the reaction product of diisocyanate and a polyol.

A "urea prepolymer" as used herein is intended to mean the reaction product of a diisocyanate and a polyamine.

The term "zwitterion" as used herein is intended to mean a form of the compound having both a positively charged species or functional group and a negatively charged species or functional group, such as an amine group and carboxylic acid group, Component (B), where both are charged and where the net charge on the compound is neutral.

The term "bimodal polymer" refers to a polymer comprising two main fractions and more specifically to the form of the polymers molecular weight distribution curve, i.e., the appearance of the graph of the polymer weight fraction as function of its molecular weight. When the molecular weight distribution curves from these fractions are superimposed into the molecular weight distribution curve for the total resulting polymer product, that curve will show two maxima or at least be distinctly broadened in comparison with the curves for the individual fractions. Such a polymer product is called bimodal. It is to be noted here that also the chemical compositions of the two fractions may be different.

Similarly the term "unimodal polymer" refers to a polymer comprising one main fraction and more specifically to the form of the polymers' molecular weight distribution curve, i.e., the molecular weight distribution curve for the total polymer product shows only a single maximum.

As used herein, a "blend composition" can be a physical mixture of components A and B and/or a reaction product produced by a reaction between components A and B.

As used herein, the term "ionomer precursor composition" is a composition containing one or more alpha olefin/unsaturated carboxylic acid polymers and/or alpha olefin/unsaturated carboxylic acid/unsaturated carboxylic acid ester terpolymers, mixed with one or more basic metal or non-metal salts capable of neutralizing the acid groups in the acid polymer.

The term "sports equipment" refers to any item of sports equipments such as sports clothing, boots, sneakers, clogs, sandals, slip on sandals and shoes, golf shoes, tennis shoes, running shoes, athletic shoes, hiking shoes, skis, ski masks, ski boots, cycling shoes, soccer boots, golf clubs, golf bags, and the like.

The present invention can be used in forming golf balls of any desired size. "The Rules of Golf" by the USGA dictate that the size of a competition golf ball must be at least 1.680 inches in diameter; however, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred; however diameters anywhere in the range of from 1.70 to about 2.0 inches can be used. Oversize golf balls with diameters above about 1.760 inches to as big as 2.75 inches are also within the scope of the invention.

II. Sulfonated Polyisoprene Ionomer ("PSI")

The polyisoprene sulfonic acids and ionomers therefrom have the following general formula:

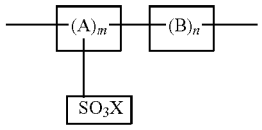

where A is an isoprene repeating unit having the formula —$CH_2$—$C(CH_3)$═CH—$CH_2$—, B is said isoprene repeating unit or other monomer repeating unit, where "isoprene" is 2-methyl-1,3-butadiene and has the formula $CH_2$═$C(CH_3)$CH═$CH_2$, m is greater than 10, preferably greater than 50 and more preferably greater than 100; and n is greater than 2, preferably greater than 5 and more preferably greater than 10; and X is hydrogen when the sulfonic acid is unneutralized and when neutralized to form the corresponding ionomer, X is $Li^+$, $Na^+$, $K^+$, $Zn^{2+}$, $Co^{2+}$, $Ni^{2+}$, $Cu^{2+}$, $Pb^{2+}$, and $Mg^{2+}$ or an ammonium cation having the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic or aromatic moiety The incorporated sulfonic acid groups are then neutralized by a basic metal or ammonium salt to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with $Li^+$, $Na^+$, $Ca^{2+}$, $Zn^{2+}$, and $Mg^{2+}$ being preferred. The ammonium cation has the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic or aromatic moiety, and any and all combinations thereof, with the most preferred being the $NH_4^+$ cation. Examples of the organic ammonium cations include methylammonium, dimethylammonium, trimethylammonium, ethylammonium, diethylammonium, triethylammonium, trihydroxymethylamine. Also included as ammonium salts of the above-mentioned polyisoprene sulfonic acids are the alcohol and alkoxy substituted ammonium cations derived from the following corresponding amines, dihydroxymethylamine, monohydroxymethylamine, monoethanolammonium, di-ethanolammonium, triethanolammonium, N-methylmonoethanol-ammonium, N-methyldiethanolammonium, monopropanolammonium, dipropanolammonium and tripropanolammonium.

The basic metal or ammonium ion salts include those derived from, for example, formic acid, acetic acid, nitric acid, and carbonic acid, hydrogen carbonate salts, oxides, hydroxides, and alkoxides.

The sulfonic acid content of the PSI ionomers is from about 2 to 80 wt % (based on the total weight of the SPI.

Polyisoprene sulfonic acid ionomers are commercially available from JSR Corporation and sold under the trademark DYNAFLOW.

III. Additional Polymer Components

Other polymeric materials generally considered useful for making golf balls may also be included as a blend component with the SPI or as a separate component of the core or one or more intermediate layers or outer cover layer of the golf balls of the present invention. These additional polymer components include, without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al., the entire contents of which is hereby incorporated by reference in its entirety), ethylene vinyl acetates, polyureas, and polysiloxanes and any and all combinations thereof.

One preferred type of polymer for blending with the SPI and/or used as a separate component of the core or one or more intermediate layers or outer cover layer of the golf balls of the present invention are the olefin/unsaturated acid containing polymers including the ethylene/(meth)acrylic acid copolymers and ethylene/(meth)acrylic acid/alkyl (meth) acrylate terpolymers, or ethylene and/or propylene maleic anhydride copolymers and terpolymers. Examples of such polymers which are commercially available include, but are not limited to, the Escor® 5000, 5001, 5020, 5050, 5070, 5100, 5110 and 5200 series of ethylene-acrylic acid copolymers sold by Exxon Mobil Chemical and the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Mich. and the ethylene-acrylic acid copolymers or ethylene-methacrylic acid copolymers including Nucrel 599, 699, 0903, 0910, 925, 960, 2806, and 2906, sold by DuPont. Also included are the bimodal ethylene/carboxylic acid polymers as described in U.S. Pat. No. 6,562,906, the contents of which are incorporated herein by reference. These polymers comprise ethylene/α, β-ethylenically unsaturated $C_{3-8}$ carboxylic acid high copolymers, particularly ethylene (meth) acrylic acid copolymers and ethylene, alkyl (meth)acrylate, (meth)acrylic acid terpolymers, having molecular weights of about 80,000 to about 500,000 which are melt blended with ethylene/α, β-ethylenically unsaturated $C_{3-8}$ carboxylic acid copolymers, particularly ethylene/(meth)acrylic acid copolymers having molecular weights of about 2,000 to about 30,000.

Another preferred polymer for blending with the SPI and/or used as a separate component of the core or one or more intermediate layers or outer cover layer of the golf balls of the present invention is an ionomer resin. One family of such resins was developed in the mid-1960's, by E.I. DuPont de Nemours and Co., and is sold under the trademark SURLYN®. Preparation of such ionomers is well known, for example see U.S. Pat. No. 3,264,272, which is incorporated herein by reference. Generally speaking, most commercial ionomers are unimodal and consist of a polymer of a monoolefin (e.g., an alkene), with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with $Li^+$, $Na^+$, $Ca^{2+}$, $Zn^{2+}$, and $Mg^{2+}$ being preferred. The basic metal ion salts include those of, for example, formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ α, β ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with basic salts comprising a metal ion selected from the group consisting of lithium, sodium, potassium, magnesium, calcium, barium, lead, tin, zinc or aluminum, or a combination of such cations.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specific embodiments include bimodal polymer blend compositions comprising:

a) a high molecular weight component having a weight average molecular weight, Mw, of about 80,000 to about 500,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said high molecular weight component being partially neutralized with basic salts comprising metal ions selected from the group consisting of lithium, sodium, zinc, calcium, magnesium, and a mixture of any these; and b) a low molecular weight component having a weight average molecular weight, Mw, of about from about 2,000 to about 30,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said low molecular weight component being partially neutralized with basic salts comprising metal ions selected from the group consisting of lithium, sodium, potassium, magnesium, calcium, barium, lead, tin, zinc or aluminum, and a mixture of any these.

In addition to the unimodal and bimodal ionomers, also included are the so-called "modified ionomers" examples of which are described in U.S. Pat. Nos. 6,100,321, 6,329,458 and 6,616,552 and U.S. Patent Publication US 2003/0158312 A1, the entire contents of all of which are herein incorporated by reference.

The modified unimodal ionomers may be prepared by mixing:

a) an ionomeric polymer comprising ethylene, from 5 to 25 weight percent (meth)acrylic acid, and from 0 to 40 weight percent of a (meth)acrylate monomer, said ionomeric polymer neutralized with basic salts comprising metal ions selected from the group consisting of lithium, sodium, potassium, magnesium, calcium, barium, lead, tin, zinc or aluminum, and any and all mixtures thereof; and b) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof. One currently preferred fatty acid is stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing:

a) a high molecular weight component having a weight average molecular weight, Mw, of about 80,000 to about 500,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said high molecular weight component being partially neutralized with basic salts comprising metal ions selected from the group consisting of lithium, sodium, potassium, magnesium, calcium, barium, lead, tin, zinc or aluminum, and any and all mixtures thereof; and b) a low molecular weight component having a weight average molecular weight, Mw, of about from about 2,000 to about 30,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; said low molecular weight component being partially neutralized with basic metal salts comprising metal ions selected from the group consisting of lithium, sodium, potassium, magnesium, calcium, barium, lead, tin, zinc or aluminum, and any and all mixtures thereof; and c) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3(CH_2)_X$ COOH, wherein the carbon atom count includes the carbon of the carboxyl group (i.e. x=2-73). The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($C_{18}$, i.e., $CH_3$ $(CH_2)_{16}$ COOH), palmitic acid ($C_{16}$, i.e., $CH_3$ $(CH_2)_{14}$ COOH), pelargonic acid ($C_9$, i.e., $CH_3$ $(CH_2)_7$ COOH) and lauric acid ($C_{12}$, i.e., $CH_3$ $(CH_2)_{10}$ OCOOH). Examples of suitable unsaturated fatty acids, i.e., a fatty acid in which there are one or more double bonds between the carbon atoms in the alkyl chain, include but are not limited to oleic acid ($C_{13}$, i.e., $CH_3$ $(CH_2)_7$ CH:CH$(CH_2)_7$ COOH).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion.

An example of such a modified ionomer polymer is DuPont® HPF-1000 available from E. I. DuPont de Nemours and Co. Inc.

Another preferred series of polymers for blending with the SPI and/or used as a separate component of the core, outer cover layer or intermediate layer(s) of the golf balls of the present invention are the polyalkenamers which may be prepared by ring opening metathesis polymerization of one or more cycloalkenes in the presence of organometallic catalysts, as described in U.S. Pat. Nos. 3,492,245, and 3,804,803, the entire contents of both of which are herein incorporated by reference. Examples of suitable polyalkenamer rubbers are polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber. For further details concerning polyalkenamer rubber, see Rubber Chem. & Tech., Vol. 47, page 511-596, 1974, which is incorporated herein by reference.

The polyalkenamer rubber preferably contains from about 50 to about 99, preferably from about 60 to about 99, more preferably from about 65 to about 99, even more preferably from about 70 to about 90 percent of its double bonds in the trans-configuration. The preferred form of the polyalkenamer has a trans content of approximately 80%, however, compounds having other ratios of the cis- and trans-isomeric forms of the polyalkenamer can also be obtained by blending available products for use in making the composition.

The polyalkenamer rubber has a molecular weight (as measured by GPC) from about 10,000 to about 300,000, preferably from about 20,000 to about 250,000, more preferably from about 30,000 to about 200,000, even more preferably from about 50,000 to about 150,000.

The polyalkenamer rubber has a degree of crystallization (as measured by DSC secondary fusion) from about 5 to about 70, preferably from about 6 to about 50, more preferably from about from 6.5 to about 50%, even more preferably from about from 7 to about 45%.

A most preferable polyalkenamer rubber for use in the golf balls of the present invention is a polyoctenamer. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring.

The polyalkenamer rubbers may also be blended within other polymers and an especially preferred blend is that of a polyalkenamer and a polyamide. A more complete description of the polyalkenamer rubbers and their polyamide blends are disclosed in U.S. Pat. No. 7,528,196 and copending U.S. application Ser. No. 12/415,522, filed on Mar. 31, 2009, both in the name of Hyun Kim et al., the entire contents of both of which are hereby incorporated by reference.

Another preferred polymer composition for blending with the SPI and/or used as a separate component of the core, outer cover layer or intermediate layer(s) of the golf balls of the present invention is a blend of a homopolyamide or copolyamide, which is itself modified with a functional polymer modifier. Illustrative polyamides for use in the polyamide compositions include those obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; (4) copolymerization of a cyclic lactam with a dicarboxylic acid and a diamine; or any combination of (1)-(4). In certain examples, the dicarboxylic acid may be an aromatic dicarboxylic acid or a cycloaliphatic dicarboxylic acid. In certain examples, the diamine may be an aromatic diamine or a cycloaliphatic diamine. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The functional polymer modifier of the polyamide used in the ball covers or intermediate layers of the present invention can include copolymers or terpolymers having a glycidyl group, hydroxyl group, maleic anhydride group or carboxylic group, collectively referred to as functionalized polymers. These copolymers and terpolymers may comprise an α-olefin. Examples of suitable α-olefins include ethylene, propylene, 1-butene, 1-pentene, 3-methyl-1-butene, 1-hexene, 4-methyl-1-petene, 3-methyl-1-pentene, 1-octene, 1-decene-, 1-dodecene, 1-tetradecene, 1-hexadecene, 1-octadecene, 1-eicocene, 1-dococene, 1-tetracocene, 1-hexacocene, 1-octacocene, and 1-triacontene. One or more of these α-olefins may be used.

Examples of suitable glycidyl groups in copolymers or terpolymers in the polymeric modifier include esters and ethers of aliphatic glycidyl, such as allylglycidylether, vinylglycidylether, glycidyl maleate and itaconatem glycidyl acrylate and methacrylate, and also alicyclic glycidyl esters and ethers, such as 2-cyclohexene-1-glycidylether, cyclohexene-4,5 diglyxidylcarboxylate, cyclohexene-4-glycidyl carobxylate, 5-norboenene-2-methyl-2-glycidyl carboxylate, and endocis-bicyclo(2,2,1)-5-heptene-2,3-diglycidyl dicarboxylate. These polymers having a glycidyl group may comprise other monomers, such as esters of unsaturated carboxylic acid, for example, alkyl(meth)acrylates or vinyl esters of unsaturated carboxylic acids. Polymers having a glycidyl group can be obtained by copolymerization or graft polymerization with homopolymers or copolymers.

Examples of suitable terpolymers having a glycidyl group include LOTADER AX8900 and AX8920, marketed by Atofina Chemicals, ELVALOY marketed by E.I. Du Pont de Nemours & Co., and REXPEARL marketed by Nippon Petrochemicals Co., Ltd. Additional examples of copolymers comprising epoxy monomers and which are suitable for use within the scope of the present invention include styrene-butadiene-styrene block copolymers in which the polybutadiene block contains epoxy group, and styrene-isoprene-styrene block copolymers in which the polyisoprene block contains epoxy. Commercially available examples of these epoxy functional copolymers include ESBS A1005, ESBS A1010, ESBS A1020, ESBS AT018, and ESBS AT019, marketed by Daicel Chemical Industries, Ltd.

Examples of polymers or terpolymers incorporating a maleic anhydride group suitable for use within the scope of the present invention include maleic anhydride-modified ethylene-propylene copolymers, maleic anhydride-modified ethylene-propylene-diene terpolymers, maleic anhydride-modified polyethylenes, maleic anhydride-modified polypropylenes, ethylene-ethylacrylate-maleic anhydride terpolymers, and maleic anhydride-indene-styrene-cumarone polymers. Examples of commercially available copolymers incorporating maleic anhydride include: BONDINE, marketed by Sumitomo Chemical Co., such as BONDINE AX8390, an ethylene-ethyl acrylate-maleic anhydride terpolymer having a combined ethylene acrylate and maleic anhydride content of 32% by weight, and BONDINE TX TX8030, an ethylene-ethyl acrylate-maleic anhydride terpolymer having a combined ethylene acrylate and maleic anhydride content of 15% by weight and a maleic anhydride content of 1% to 4% by weight; maleic anhydride-containing LOTADER 3200, 3210, 6200, 8200, 3300, 3400, 3410, 7500, 5500, 4720, and 4700, marketed by Atofina Chemicals; EXXELOR VA1803, a maleic anyhydride-modified ethylene-propylene copolymer having a maleic anyhydride content of 0.7% by weight, marketed by Exxon Chemical Co.; and KRATON FG 1901X, a maleic anhydride functionalized triblock copolymer having polystyrene endblocks and poly(ethylene/butylene) midblocks, marketed by Shell Chemical. Preferably the functional polymer component is a maleic anhydride grafted polymers preferably maleic anhydride grafted polyolefins (for example, Exxellor VA1803).

Another preferred polymer for blending with the SPI and/or used as a separate component of the core, outer cover layer or intermediate layer(s) of the golf balls of the present invention is the family of polyurethanes or polyureas which are typically are prepared by reacting a diisocyanate with a polyol (in the case of polyurethanes) or with a polyamine (in the case of a polyurea). Thermoplastic polyurethanes or polyureas may consist solely of this initial mixture or may be further combined with a chain extender to vary properties such as hardness of the thermoplastic. Thermoset polyurethanes or polyureas typically are formed by the reaction of a diisocyanate and a polyol or polyamine respectively, and an additional crosslinking agent to crosslink or cure the material to result in a thermoset.

In what is known as a one-shot process, the three reactants, diisocyanate, polyol or polyamine, and optionally a chain extender or a curing agent, are combined in one step. Alternatively, a two-step process may occur in which the first step involves reacting the diisocyanate and the polyol (in the case of polyurethane) or the polyamine (in the case of a polyurea) to form a so-called prepolymer, to which can then be added either the chain extender or the curing agent. This procedure is known as the prepolymer process.

In addition, although depicted as discrete component packages as above, it is also possible to control the degree of crosslinking, and hence the degree of thermoplastic or thermoset properties in a final composition, by varying the stoichiometry not only of the diisocyanate-to-chain extender or curing agent ratio, but also the initial diisocyanate-to-polyol or polyamine ratio. Of course in the prepolymer process, the initial diisocyanate-to-polyol or polyamine ratio is fixed on selection of the required prepolymer.

In addition to discrete thermoplastic or thermoset materials, it also is possible to modify a thermoplastic polyurethane or polyurea composition by introducing materials in the composition that undergo subsequent curing after molding the thermoplastic to provide properties similar to those of a thermoset. For example, Kim in U.S. Pat. No. 6,924,337, the entire contents of which are hereby incorporated by reference, discloses a thermoplastic urethane or urea composition optionally comprising chain extenders and further comprising a peroxide or peroxide mixture, which can then undergo post curing to result in a thermoset.

Also, Kim et al. in U.S. Pat. No. 6,939,924, the entire contents of which are hereby incorporated by reference, discloses a thermoplastic urethane or urea composition, optionally also comprising chain extenders, that is prepared from a diisocyanate and a modified or blocked diisocyanate which unblocks and induces further cross linking post extrusion. The modified isocyanate preferably is selected from the group consisting of: isophorone diisocyanate (IPDI)-based uretdione-type crosslinker; a combination of a uretdione adduct of IPDI and a partially e-caprolactam-modified IPDI; a combination of isocyanate adducts modified by e-caprolactam and a carboxylic acid functional group; a caprolactam-modified Desmodur diisocyanate; a Desmodur diisocyanate having a 3,5-dimethylpyrazole modified isocyanate; or mixtures of these.

Finally, Kim et al. in U.S. Pat. No. 7,037,985 B2, the entire contents of which are hereby incorporated by reference, discloses thermoplastic urethane or urea compositions further comprising a reaction product of a nitroso compound and a diisocyanate or a polyisocyanate. The nitroso reaction product has a characteristic temperature at which it decomposes to regenerate the nitroso compound and diisocyanate or polyisocyanate. Thus, by judicious choice of the post-processing temperature, further crosslinking can be induced in the originally thermoplastic composition to provide thermoset-like properties.

Any isocyanate available to one of ordinary skill in the art is suitable for use according to the invention. Isocyanates for use with the present invention include, but are not limited to, aliphatic, cycloaliphatic, aromatic aliphatic, aromatic, any derivatives thereof, and combinations of these compounds having two or more isocyanate (NCO) groups per molecule. As used herein, aromatic aliphatic compounds should be understood as those containing an aromatic ring, wherein the isocyanate group is not directly bonded to the ring. One example of an aromatic aliphatic compound is a tetramethylene diisocyanate (TMXDI). The isocyanates may be organic polyisocyanate-terminated prepolymers, low free isocyanate prepolymer, and mixtures thereof. The isocyanate-containing reactable component also may include any isocyanate-functional monomer, dimer, trimer, or polymeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R preferably is a cyclic, aromatic, or linear or branched hydrocarbon moiety containing from about 1 to about 50 carbon atoms. The isocyanate also may contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of isocyanates that can be used with the present invention include, but are not limited to, substituted and isomeric mixtures including 2,2'-, 2,4'-, and 4,4'-diphenylmethane diisocyanate (MDI); 3,3'-dimethyl-4,4'-biphenylene diisocyanate (TODI); toluene diisocyanate (TDI); polymeric MDI; carbodiimide-modified liquid 4,4'-diphenylmethane diisocyanate; para-phenylene diisocyanate (PPDI); meta-phenylene diisocyanate (MPDI); triphenyl methane-4,4'- and triphenyl methane-4,4"-triisocyanate; naphthylene-1,5-diisocyanate; 2,4'-, 4,4'-, and 2,2-biphenyl diisocyanate; polyphenylene polymethylene polyisocyanate (PMDI) (also known as polymeric PMDI); mixtures of MDI and PMDI; mixtures of PMDI and TDI; ethylene diisocyanate; propylene-1,2-diisocyanate; trimethylene diisocyanate; butylenes diisocyanate; bitolylene diisocyanate; tolidine diisocyanate; tetramethylene-1,2-diisocyanate; tetramethylene-1,3-diisocyanate; tetramethylene-1,4-diisocyanate; pentamethylene diisocyanate; 1,6-hexamethylene diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; diethylidene diisocyanate; methylcyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane;
isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophorone diisocyanate (IPDI); dimeryl diisocyanate, dodecane-1,12-diisocyanate, 1,10-decamethylene diisocyanate, cyclohexylene-1,2-diisocyanate, 1,10-decamethylene diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3-cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis(phenyl isocyanate), 1-methyl-2,4-cyclohexane diisocyanate, 1-methyl-2,6-cyclohexane diisocyanate, 1,3-bis (isocyanato-methyl)cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclohexyl isocyanate, dicyclohexylmethane 4,4'-diisocyanate, 1,4-bis(isocyanatomethyl)cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianidine diisocyanate, 4,4'-diphenyl ether diisocyanate, 1,3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω,ω'-diisocyanato-1,4-diethylbenzene, polymethylene polyphenylene polyisocyanate, isocyanurate modified compounds, and carbodiimide modified compounds, as well as biuret modified compounds of the above polyisocyanates. These isocyanates may be used either alone or in combination. These combination isocyanates include triisocyanates, such as biuret of hexamethylene diisocyanate and triphenylmethane triisocyanates, and polyisocyanates, such as polymeric diphenylmethane diisocyanate.triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, and mixtures thereof, dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

Any polyol now known or hereafter developed is suitable for use according to the invention. Polyols suitable for use in the present invention include, but are not limited to, polyester polyols, polyether polyols, polycarbonate polyols and polydiene polyols such as polybutadiene polyols.

Any polyamine available to one of ordinary skill in the polyurethane art is suitable for use according to the invention. Polyamines suitable for use in the compositions of the present invention include, but are not limited to amine-terminated compounds typically are selected from amine-terminated hydrocarbons, amine-terminated polyethers, amine-terminated polyesters, amine-terminated polycaprolactones, amine-terminated polycarbonates, amine-terminated polyamides, and mixtures thereof. The amine-terminated compound may be a polyether amine selected from polytetramethylene ether diamines, polyoxypropylene diamines, poly (ethylene oxide capped oxypropylene)ether diamines, triethyleneglycoldiamines, propylene oxide-based triamines, trimethylolpropane-based triamines, glycerin-based triamines, and mixtures thereof.

The diisocyanate and polyol or polyamine components may be combined to form a prepolymer prior to reaction with a chain extender or curing agent. Any such prepolymer combination is suitable for use in the present invention.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

In one embodiment, the number of free NCO groups in the urethane or urea prepolymer may be less than about 14 percent. Preferably the urethane or urea prepolymer has from about 3 percent to about 11 percent, more preferably from about 4 to about 9.5 percent, and even more preferably from about 3 percent to about 9 percent, free NCO on an equivalent weight basis.

Polyol chain extenders or curing agents may be primary, secondary, or tertiary polyols. Non-limiting examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol.

Diamines and other suitable polyamines may be added to the compositions of the present invention to function as chain extenders or curing agents. These include primary, secondary and tertiary amines having two or more amines as functional groups. Exemplary diamines include aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, 4,4'-methylene bis-2-chloroaniline, 2,2',3,3'-tetrachloro-4,4'-diamino-phenyl methane, p,p'-methylenedianiline, p-phenylenediamine or 4,4'-diaminodiphenyl; and 2,4,6-tris(dimethylaminomethyl) phenol.

Depending on their chemical structure, curing agents may be slow- or fast-reacting polyamines or polyols. As described in U.S. Pat. Nos. 6,793,864, 6,719,646 and copending U.S. Patent Publication No. US 2004/0201133 A1, (the contents of all of which are hereby incorporated herein by reference), slow-reacting polyamines are diamines having amine groups that are sterically and/or electronically hindered by electron withdrawing groups or bulky groups situated proximate to the amine reaction sites. The spacing of the amine reaction sites will also affect the reactivity speed of the polyamines.

Suitable curatives include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP.

Also included as a curing agent for use in the polyurethane or polyurea compositions used in the present invention is the family of dicyandiamides as described in copending U.S. application Ser. No. 11/809,432 filed on May 31, 2007, by Kim et al., the entire contents of which is hereby incorporated by reference.

In one embodiment of the present invention the SPI is used as a single polymeric component of a golf ball core, outer cover and one or more intermediate layers.

In another embodiment of the present invention, the SPI may also be blended with one or more of the heretofore described additional polymer components. Thus the core, cover and/or one or more intermediate layer compositions of the golf balls of the present invention may comprise from about 30 to about 100, preferably from about 40 to about 90, more preferably from about 50 to about 85 and most preferably from about 55 to about 75 wt % of the SPI and from 0 to about 70, preferably from about 10 to about 60, more preferably from about 15 to about 50 and most preferably from about 25 to about 45 wt % of one or more additional polymer components (all percentages based on the combined weight of the SPI and the one or more additional polymer components).

The melt index (MFI measured using ASTM D-1238, 230° C. and 2.16 kg load) of the SPI or blend of the SPI with one or more additional polymer components is greater than about 5, preferably greater than about 10, most preferably greater than about 15 g/10 minute.

In a preferred embodiment the additional polymer component is an olefin/unsaturated acid containing polymer including the ethylene/(meth)acrylic acid copolymers and ethylene/(meth)acrylic acid/alkyl (meth)acrylate terpolymers, or ethylene and/or propylene maleic anhydride copolymers and terpolymers.

In another preferred embodiment the additional polymer component is an olefin/unsaturated acid containing polymer including the ethylene/(meth)acrylic acid copolymers and ethylene/(meth)acrylic acid/alkyl (meth)acrylate terpolymers, or ethylene and/or propylene maleic anhydride copolymers and terpolymers and then from about 0 to about 100, preferably from about 5 to about 90, more preferably from about 10 to about 80 and most preferably from about 12 to about 75 weight percent of the acid groups in the resulting blend composition (based on the final weight of the blend composition) are then neutralized with a basic metal ion salt. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

In another preferred embodiments the additional polymer component is a unimodal ionomer or a bimodal ionomer or a modified unimodal ionomer or a modified bimodal ionomer or any and all combinations thereof.

IV. Core Composition

In addition to the SPI, the cores of the golf balls of the present invention may include the traditional rubber components used in golf ball applications including, both natural and synthetic rubbers, such as cis-1,4-polybutadiene, trans-1,4-polybutadiene, 1,2-polybutadiene, cis-polyisoprene, trans-polyisoprene, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

The 1,4-polybutadiene rubbers have a molecular weight distribution (Mw/Mn) of from about 1.2 to about 4.0, preferably from about 1.7 to about 3.7, even more preferably from about 2.0 to about 3.5, most preferably from about 2.2 to about 3.2. The polybutadiene rubbers have a Mooney viscosity ($ML_{1+4}$ (100° C.)) of from about 20 to about 80, preferably from about 30 to about 70, even more preferably from about 30 to about 60, most preferably from about 35 to about 50. The term "Mooney viscosity" used herein refers in each case to an industrial index of viscosity as measured with a Mooney viscometer, which is a type of rotary plastometer (see JIS K6300). This value is represented by the symbol $ML_{1+4}$ (100° C.), wherein "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C. As readily appreciated by a person of ordinary skill in the art, blends of polybutadiene rubbers may also be utilized in the golf balls of the present invention, such blends may be prepared with any mixture of rare earth-based catalysts, nickel-based catalysts, or cobalt-based catalysts derived materials, and from materials having different molecular weights, molecular weight distributions and Mooney viscosity.

The cores of the golf balls of the present invention may also include 1,2-polybutadienes having differing tacticity, all of which are suitable as unsaturated polymers for use in the presently disclosed compositions, are atactic 1,2-polybutadiene, isotactic 1,2-polybutadiene, and syndiotactic 1,2-polybutadiene. Syndiotactic 1,2-polybutadiene having crystallinity suitable for use as an unsaturated polymer in the presently disclosed compositions are polymerized from a 1,2-addition of butadiene. The presently disclosed golf balls may include syndiotactic 1,2-polybutadiene having crystallinity and greater than about 70% of 1,2-bonds, more preferably greater than about 80% of 1,2-bonds, and most preferably greater than about 90% of 1,2-bonds. Also, the 1,2-polybutadiene may have a mean molecular weight between about 10,000 and about 350,000, more preferably between about 50,000 and about 300,000, more preferably between about 80,000 and about 200,000, and most preferably between about 10,000 and about 150,000. Examples of suitable syndiotactic 1,2-polybutadienes having crystallinity suitable for use in golf balls are sold under the trade names RB810, RB820, and RB830 by JSR Corporation of Tokyo, Japan.

The cores of the golf balls of the present invention may also include the polyalkenamer rubbers as previously described herein and disclosed in copending U.S. application Ser. No. 11/335,070, filed on Jan. 18, 2006, in the name of Hyun Kim et al., the entire contents of which are hereby incorporated by reference.

When synthetic rubbers such as the aforementioned polybutadienes or polyalkenamers and their blends are used in the golf balls of the present invention they may contain further materials typically often used in rubber formulations including crosslinking agents, co-crosslinking agents, peptizers and accelerators. Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides. Peroxides containing more than one peroxy group can be used, such as 2,5-dimethyl-2,5-di(tert-butylperoxy)hexane and 1,4-di-(2-tert-butyl peroxyisopropyl)benzene. Both symmetrical and asymmetrical peroxides can be used, for example, tert-butyl perbenzoate and tert-butyl cumyl peroxide. Peroxides incorporating carboxyl groups also are suitable. The decomposition of peroxides used as cross-linking agents in the present invention can be brought about by applying thermal energy, shear, irradiation, reaction with other chemicals, or any combination of these. Both homolytically and heterolytically decomposed peroxide can be used in the present invention. Non-limiting examples of suitable peroxides include: diacetyl peroxide; di-tert-butyl peroxide; dibenzoyl peroxide; dicumyl peroxide; 2,5-dimethyl-2,5-di(benzoylperoxy)hexane; 1,4-bis-(t-butylperoxyisopropyl)benzene; t-butylperoxybenzoate; butylperoxy)hexyne-3, such as Trigonox 145-45B, marketed by Akrochem Corp. of Akron, Ohio; 1,1-bis(t-butylperoxy)-3,3,5 tri-methylcyclohexane, such as Varox 231-XL, marketed by R.T. Vanderbilt Co., Inc. of Norwalk, Conn.; and di-(2,4-dichlorobenzoyl)peroxide. The cross-linking agents can be blended in total amounts of about 0.05 parts to about 5 parts, more preferably about 0.2 part to about 3 parts, and most preferably about 0.2 part to about 2 parts, by weight of the cross-linking agents per 100 parts by weight of the unsaturated polymer.

Each cross-linking agent has a characteristic decomposition temperature at which 50% of the cross-linking agent has decomposed when subjected to that temperature for a specified time period ($t_{1/2}$). For example, 1,1-bis-(t-butylperoxy)-3,3,5-tri-methylcyclohexane at $t_{1/2}$=0.1 hour has a decomposition temperature of 138° C. and 2,5-dimethyl-2,5-di-(t-butylperoxy)hexyne-3 at $t_{1/2}$=0.1 hour has a decomposition temperature of 182° C. Two or more cross-linking agents having different characteristic decomposition temperatures at the same $t_{1/2}$ may be blended in the composition. For example, where at least one cross-linking agent has a first characteristic decomposition temperature less than 150° C., and at least one cross-linking agent has a second characteristic decomposition temperature greater than 150° C., the composition weight ratio of the at least one cross-linking agent having the first characteristic decomposition temperature to the at least one cross-linking agent having the second characteristic decomposition temperature can range from 5:95 to 95:5, or more preferably from 10:90 to 50:50.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

The rubber and cross-linking agent may be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The unsaturated carboxylic acid metal salt can be blended in a rubber either as a preformed metal salt, or by introducing an α, β-unsaturated carboxylic acid and a metal oxide or hydroxide into the rubber composition, and allowing them to react in the rubber composition to form a metal salt. The unsaturated carboxylic acid metal salt can be blended in any desired amount, but preferably in amounts of about 10 parts to about 60 parts by weight of the unsaturated carboxylic acid per 100 parts by weight of the synthetic rubber.

The core compositions used in the present invention may also incorporate one or more of the so-called "peptizers". The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl) disulfide; dibenzamido diphenyldisulfide (DBDD), and alkylated phenol sulfides, such as VULTAC marketed by Atofina Chemicals, Inc. of Philadelphia, Pa. Preferred organic sulfur compounds include pentachlorothiophenol, and dibenzamido diphenyldisulfide.

Examples of the metal salt of an organic sulfur compound include sodium, potassium, lithium, magnesium calcium, barium, and cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR^1R^2R^3R^4]^{30}$. $R^1$, $R^2$, $R^3$ and $R^4$ are independently selected from the group consisting of hydrogen, a $C_1$-$C_{20}$ aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers.

Suitable peptizers also may include one or more additional functional groups, such as halogens, particularly chlorine; a sulfur-containing moiety exemplified by thiols, where the functional group is sulfhydryl (—SH), thioethers, where the functional group is —SR, disulfides, ($R_1$ S—$SR_2$), etc.; and combinations of functional groups. Such peptizers are more fully disclosed in copending U.S. Application No. 60/752,475 filed on Dec. 20, 2005, in the name of Hyun Kim et al., the entire contents of which are herein incorporated by reference. A most preferred example is 2,3,5,6-tetrachloro-4-pyridinethiol (TCPT).

The peptizer, if employed in the golf balls of the present invention, is present in an amount up to about 10, from about 0.01 to about 10, preferably of from about 0.10 to about 7, more preferably of from about 0.15 to about 5 parts by weight per 100 parts by weight of the synthetic rubber component.

The core compositions can also comprise one or more accelerators of one or more classes. Accelerators are added to an unsaturated polymer to increase the vulcanization rate and/or decrease the vulcanization temperature. Accelerators can be of any class known for rubber processing including mercapto-, sulfenamide-, thiuram, dithiocarbamate, dithiocarbamyl-sulfenamide, xanthate, guanidine, amine, thiourea, and dithiophosphate accelerators. Specific commercial accelerators include 2-mercaptobenzothiazole and its metal or non-metal salts, such as Vulkacit Mercapto C, Mercapto MGC, Mercapto ZM-5, and ZM marketed by Bayer AG of Leverkusen, Germany, Nocceler M, Nocceler MZ, and Nocceler M-60 marketed by Ouchisinko Chemical Industrial Company, Ltd. of Tokyo, Japan, and MBT and ZMBT marketed by Akrochem Corporation of Akron, Ohio. A more complete list of commercially available accelerators is given in The Vanderbilt Rubber Handbook: 13$^{th}$ Edition (1990, R.T. Vanderbilt Co.), pp. 296-330, in Encyclopedia of Polymer Science and Technology, Vol. 12 (1970, John Wiley & Sons), pp. 258-259, and in Rubber Technology Handbook (1980, Hanser/Gardner Publications), pp. 234-236. Preferred accelerators include 2-mercaptobenzothiazole (MBT) and its salts. The synthetic rubber composition can further incorporate from about 0.1 part to about 10 parts by weight of the accelerator per 100 parts by weight of the rubber. More preferably, the ball composition can further incorporate from about 0.2 part to about 5 parts, and most preferably from about 0.5 part to about 1.5 parts, by weight of the accelerator per 100 parts by weight of the rubber.

V. Fillers

The crosslinked ionomer composition and other various polymeric compositions used to prepare the golf balls of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred aspect the filler comprises a continuous or non-continuous fiber. In another preferred aspect the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Inorganic nanofiller material generally is made of clay, such as hydrotalcite, phyllosilicate, saponite, hectorite, beidellite, stevensite, vermiculite, halloysite, mica, montmorillonite, micafluoride, or octosilicate. To facilitate incorporation of the nanofiller material into a polymer material, either in preparing nanocomposite materials or in preparing polymer-based golf ball compositions, the clay particles generally are coated or treated by a suitable compatibilizing agent. The compatibilizing agent allows for superior linkage between the inorganic and organic material, and it also can account for the hydrophilic nature of the inorganic nanofiller material and the possibly hydrophobic nature of the polymer. Compatibilizing agents may exhibit a variety of different structures depending upon the nature of both the inorganic nanofiller material and the target matrix polymer. Non-limiting examples include hydroxy-, thiol-, amino-, epoxy-, carboxylic acid-, ester-, amide-, and siloxy-group containing compounds, oligomers or polymers. The nanofiller materials can be incorporated into the polymer either by dispersion into the particular monomer or oligomer prior to polymerization, or by melt compounding of the particles into the matrix polymer.

Examples of commercial nanofillers are various Cloisite grades including 10A, 15A, 20A, 25A, 30B, and NA+ of Southern Clay Products (Gonzales, Tex.) and the Nanomer grades including 1.24TL and C.30EVA of Nanocor, Inc. (Arlington Heights, Ill.).

Nanofillers when added into a matrix polymer, such as the polyalkenamer rubber, can be mixed in three ways. In one type of mixing there is dispersion of the aggregate structures within the matrix polymer, but on mixing no interaction of the matrix polymer with the aggregate platelet structure occurs, and thus the stacked platelet structure is essentially maintained. As used herein, this type of mixing is defined as "undispersed".

However, if the nanofiller material is selected correctly, the matrix polymer chains can penetrate into the aggregates and separate the platelets, and thus when viewed by transmission electron microscopy or x-ray diffraction, the aggregates of platelets are expanded. At this point the nanofiller is said to be substantially evenly dispersed within and reacted into the structure of the matrix polymer. This level of expansion can occur to differing degrees. If small amounts of the matrix polymer are layered between the individual platelets then, as used herein, this type of mixing is known as "intercalation".

In some circumstances, further penetration of the matrix polymer chains into the aggregate structure separates the platelets, and leads to a complete disruption of the platelet's stacked structure in the aggregate. Thus, when viewed by transmission electron microscopy (TEM), the individual platelets are thoroughly mixed throughout the matrix polymer. As used herein, this type of mixing is known as "exfoliated". An exfoliated nanofiller has the platelets fully dispersed throughout the polymer matrix; the platelets may be dispersed unevenly but preferably are dispersed evenly.

While not wishing to be limited to any theory, one possible explanation of the differing degrees of dispersion of such nanofillers within the matrix polymer structure is the effect of the compatibilizer surface coating on the interaction between the nanofiller platelet structure and the matrix polymer. By careful selection of the nanofiller it is possible to vary the penetration of the matrix polymer into the platelet structure of the nanofiller on mixing. Thus, the degree of interaction and intrusion of the polymer matrix into the nanofiller controls the separation and dispersion of the individual platelets of the nanofiller within the polymer matrix. This interaction of the polymer matrix and the platelet structure of the nanofiller is defined herein as the nanofiller "reacting into the structure of the polymer" and the subsequent dispersion of the platelets within the polymer matrix is defined herein as the nanofiller "being substantially evenly dispersed" within the structure of the polymer matrix.

If no compatibilizer is present on the surface of a filler such as a clay, or if the coating of the clay is attempted after its addition to the polymer matrix, then the penetration of the matrix polymer into the nanofiller is much less efficient, very little separation and no dispersion of the individual clay platelets occurs within the matrix polymer.

Physical properties of the polymer will change with the addition of nanofiller. The physical properties of the polymer are expected to improve even more as the nanofiller is dispersed into the polymer matrix to form a nanocomposite.

Materials incorporating nanofiller materials can provide these property improvements at much lower densities than those incorporating conventional fillers. For example, a nylon-6 nanocomposite material manufactured by RTP Corporation of Wichita, Kans., uses a 3% to 5% clay loading and has a tensile strength of 11,800 psi and a specific gravity of 1.14, while a conventional 30% mineral-filled material has a tensile strength of 8,000 psi and a specific gravity of 1.36. Using nanocomposite materials with lower inorganic materials loadings than conventional fillers provides the same properties, and this allows products comprising nanocomposite fillers to be lighter than those with conventional fillers, while maintaining those same properties.

Nanocomposite materials are materials incorporating up to about 20%, or from about 0.1% to about 20%, preferably from about 0.1% to about 15%, and most preferably from about 0.1% to about 10% of nanofiller reacted into and substantially dispersed through intercalation or exfoliation into the structure of an organic material, such as a polymer, to provide strength, temperature resistance, and other property improvements to the resulting composite. Descriptions of particular nanocomposite materials and their manufacture can be found in U.S. Pat. Nos. 5,962,553 to Ellsworth, 5,385,776 to Maxfield et al., and 4,894,411 to Okada et al., each of which is incorporated herein by reference. Examples of nanocomposite materials currently marketed include M1030D, manufactured by Unitika Limited, of Osaka, Japan, and 1015C2, manufactured by UBE America of New York, N.Y.

When nanocomposites are blended with other polymer systems, the nanocomposite may be considered a type of nanofiller concentrate. However, a nanofiller concentrate may be more generally a polymer into which nanofiller is mixed; a nanofiller concentrate does not require that the nanofiller has reacted and/or dispersed evenly into the carrier polymer.

The nanofiller material is added in an amount up to about 20 wt %, from about 0.1% to about 20%, preferably from about 0.1% to about 15%, and most preferably from about 0.1% to about 10% by weight (based on the final weight of the polymer matrix material) of nanofiller reacted into and substantially dispersed through intercalation or exfoliation into the structure of the polymer matrix.

If desired, the various polymer compositions used to prepare the golf balls of the present invention can additionally contain other conventional additives such as plasticizers, pigments, antioxidants, U.V. absorbers, optical brighteners, or any other additives generally employed in plastics formulation or the preparation of golf balls. Another particularly well-suited additive for use in the crosslinked ionomer composition or other various polymer compositions used to prepare the golf balls of the present invention includes compounds having the general formula:

$$(R_2N)_m—R'—(X(O)_n(OR)_y)_m,$$

where R is hydrogen, or a $C_1$-$C_{20}$ aliphatic, cycloaliphatic or aromatic systems; R' is a bridging group comprising one or more $C_1$-$C_{20}$ straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=0-1 and y=2 or 4. Also, m=1-3. These materials are more fully described in copending U.S. patent application Ser. No. 11/182,170, filed on Jul. 14, 2005, the entire contents of which are incorporated herein by reference. Preferably the material is selected from the group consisting of 4,4'-methylene-bis-(cyclohexylamine)carbamate (commercially available from R.T. Vanderbilt Co., Norwalk, Conn. under the tradename Diak® 4), 11-aminoundecanoic acid, 12-aminododecanoic acid, epsilon-caprolactam; omega-caprolactam, and any and all combinations thereof.

In an especially preferred aspect, a nanofiller additive component in the golf ball of the present invention is surface modified with a compatibilizing agent comprising the earlier described compounds having the general formula:

$$(R_2N)_m—R'—(X(O)_n(OR)_y)_m,$$

A most preferred aspect would be a filler comprising a nanofiller clay material surface modified with an amino acid including 12-aminododecanoic acid. Such fillers are available from Nanonocor Co. under the tradename Nanomer 1.24TL.

The filler can be blended in variable effective amounts, such as amounts of greater than 0 to at least about 80 parts, and more typically from about 10 parts to about 80 parts, by weight per 100 parts by weight of the base rubber. If desired, the rubber composition can additionally contain effective amounts of a plasticizer, an antioxidant, and any other additives generally used to make golf balls.

The SPI used as a component of the golf balls of the present invention or any other ionomer added as a blend component or used to form a component of the golf balls of the present invention, may also be further modified by addition of a monomeric aliphatic and/or aromatic amide as described in copending U.S. patent application Ser. No. 11/592,109 filed on Nov. 1, 2006, in the name of Hyun Kim et al., the entire contents of which are hereby incorporated by reference.

Golf balls within the scope of the present invention also can include, in suitable amounts, one or more additional ingredients generally employed in golf ball compositions. Agents provided to achieve specific functions, such as additives and stabilizers, can be present. Exemplary suitable ingredients include colorants, antioxidants, colorants, dispersants, mold releasing agents, processing aids, fillers, and any and all combinations thereof. Although not required, UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN.

The SPI composition used to prepare the golf balls of the present invention can be i) used directly; or ii) first blended with any additional polymeric blend component; or iii) the sulfonic acid substituted polyisoprene, the ionomer precursor, can be first mixed with the neutralizing agent (the basic metal or non-metal salt) to form the SPI and then used directly; or iv) the first formed SPI in iii) can then be blended with any additional polymeric blend component; or v) an in situ method can be used in which the sulfonic acid substituted polyisoprene, the neutralizing agent and any additional polymeric blend component are mixed simultaneously; or vi) any and all combinations of the above methods.

The methods of mixing the presently described SPI compositions can incorporate a number of known processes. The components can be mixed together using dry blending equipment, such as a tumbler mixer, V-blender, or ribbon blender, or by using a mill, internal mixer, extruder or combinations of these, with or without application of thermal energy to produce melting or chemical reaction. For example, the neutralizing agent can be added as a concentrate using dry blending or melt mixing. A color concentrate, can be added to the SPI composition to impart a white color to golf ball. Any combination of the above-mentioned mixing processes can be used.

The various SPI formulations may be produced using a twin-screw extruder or may be blended manually or mechanically prior to the addition to the injection molder feed hopper. Finished golf balls may be prepared by initially positioning the solid, preformed core in an injection-molding cavity, followed by uniform injection of the intermediate layer and/or cover layer composition sequentially over the core. The cover formulations can be injection molded around the cores to produce golf balls of the required diameter. Alternatively, the cover layers may also be formed around the core by first forming half shells by injection molding followed by compression molding the half shells about the core to form the final ball. Covers may also be formed around the cores using compression molding. Cover materials for compression molding may also be extruded or blended resins or castable resins such as thermoset polyurethane and thermoset polyurea.

Typically the golf ball core is made by mixing together the unsaturated polymer, cross-linking agents, and other additives with or without melting them. Dry blending equipment, such as a tumbler mixer, V blender, ribbon blender, or two-roll mill, can be used to mix the compositions. The golf ball compositions can also be mixed using a mill, internal mixer such as a Banbury or Farrel continuous mixer, extruder or combinations of these, with or without application of thermal energy to produce melting. The various core components can be mixed together with the cross-linking agents, or each additive can be added in an appropriate sequence to the milled unsaturated polymer. In another method of manufacture the cross-linking agents and other components can be added to the unsaturated polymer as part of a concentrate using dry blending, roll milling, or melt mixing. If radiation is a cross-linking agent, then the mixture comprising the unsaturated polymer and other additives can be irradiated following mixing, during forming into a part such as the core of a ball, or after forming.

The resulting mixture can be subjected to, for example, a compression or injection molding process, to obtain solid spheres for the core. The polymer mixture is subjected to a molding cycle in which heat and pressure are applied while the mixture is confined within a mold. The cavity shape depends on the portion of the golf ball being formed. The compression and heat liberates free radicals by decomposing one or more peroxides, which initiate cross-linking. The temperature and duration of the molding cycle are selected based upon the type of peroxide and peptizer selected. The molding cycle may have a single step of molding the mixture at a single temperature for fixed time duration.

For example, a preferred mode of preparation for the cores used in the present invention is to first mix the core ingredients on a two-roll mill, to form slugs of approximately 30-40 g, and then compression-mold in a single step at a temperature between 150 to 180° C., for a time duration between 5 and 12 minutes.

The various core components may also be combined to form a golf ball by an injection molding process, which is also well known to one of ordinary skill in the art. The curing time depends on the various materials selected, and those of ordinary skill in the art will be readily able to adjust the curing time upward or downward based on the particular materials used and the discussion herein.

The golf ball of the present invention may comprise from 0 to 5, preferably from 0 to 3, more preferably from 1 to 3, most preferably 1 to 2 intermediate layer(s).

In one preferred aspect, the golf ball is a multi-piece ball with the SPI composition, used in the outer cover layer.

In one preferred aspect, the golf ball is a multi-piece ball with the SPI composition, used in the core.

In one preferred aspect, the golf ball is a multi-piece ball with the SPI composition, used in one or more intermediate or mantle layers.

In one preferred aspect, the golf ball is a multi-piece ball with the SPI composition, used in the intermediate or mantle layer, and the outer cover comprises a thermoplastic elastomer, a thermoplastic or thermoset polyurethane, a thermoplastic or thermoset polyurea, an ionomer, or the reaction product of an ethylene/(meth)acrylic acid copolymers and/or an ethylene/(meth)acrylic acid/alkyl (meth)acrylate terpolymers with a styrenic block copolymer and a metal hydroxide, metal oxide, metal stearate, metal carbonate, or metal acetate.

The SPI ionomer composition used to make the golf balls of the present invention has a material Shore D hardness of from about 25 to about 85, preferably from about 30 to about 80, more preferably from about 35 to about 75.

The SPI composition used to make the golf balls of the present invention has a flexural modulus from about 5 to about 500, preferably from about 15 to about 400, more preferably from about 20 to about 300, still more preferably from about 25 to about 200, and most preferably from about 30 to about 150 kpsi.

Spheres of the SPI composition used to make the golf balls of the present invention may be made by injection molding for the purposes of evaluating their property performance. The SPI composition used to make the golf balls of the present invention when formed into such spheres has a PGA compression of from about 30 to about 200, preferably from about 35 to about 185, more preferably from about 45 to about 180; and a COR greater than about 0.500, preferably greater than 0.600, more preferably greater than about 0.650, and most preferably greater than 0.700 at 125 ft/sec inbound velocity.

The core of the balls of the present invention may have a diameter of from about 0.5 to about 1.62, preferably from about 0.7 to about 1.60, more preferably from about 1 to about 1.58, yet more preferably from about 1.20 to about 1.54, and most preferably from about 1.40 to about 1.50 in.

The core of the balls of the present invention may have a PGA compression of less than about 140, preferably less than about 120, more preferably less than about 100, yet more preferably less than about 90, and most preferably less than about 80.

The various core layers (including the center) may each exhibit a different hardness. The difference between the center hardness and that of the next adjacent layer, as well as the difference in hardness between the various core layers may be greater than 2, preferably greater than 5, most preferably greater than 10 units of Shore D.

In one preferred aspect, the hardness of the center and each sequential layer increases progressively outwards from the center to outer core layer.

In another preferred aspect, the hardness of the center and each sequential layer decreases progressively inwards from the outer core layer to the center.

The one or more intermediate layers of the golf balls of the present invention may have a thickness of about 0.01 to about 0.50 or about 0.01 to about 0.20, preferably from about 0.02 to about 0.30 or from about 0.02 to about 0.15, more preferably from about 0.03 to about 0.20 or from about 0.03 to about 0.10, and most preferably from about 0.03 to about 0.10 or about 0.03 to about 0.06 in.

The one or more intermediate layers of the golf balls of the present invention may have a hardness as measured on the ball of greater than about 25, preferably greater than about 30, more preferably greater than about 40, and most preferably greater than about 50, Shore D units.

The cover layer of the golf balls of the present invention may have a thickness of about 0.01 to about 0.10, preferably from about 0.02 to about 0.08, more preferably from about 0.03 to about 0.06 in.

The cover layer the golf balls of the present invention may have a Shore D hardness as measured on the ball from about 35 to about 70, preferably from about 45 to about 70 or about 50 to about 70, more preferably from 47 to about 68 or about 45 to about 70, and most preferably from about 50 to about 65.

The COR of the golf balls of the present invention may be greater than about 0.760, preferably greater than about 0.780, more preferably greater than 0.790, most preferably greater than 0.795, and especially greater than 0.800 at 125 ft/sec inbound velocity.

VI. Examples

Examples of the golf balls of the present invention may be prepared using the following materials and method which are given below by way of illustration and not by way of limitation. The materials that may be employed include:

ESCOR 5200, an ethylene acrylic acid copolymer commercially available from Exxon Mobil Chemical.

DYNAFLOW K200 and 201 are sulfonated polyisoprene resins manufactured by JSR Corporation.

ZnO a rubber grade zinc oxide purchased from Akrochem (Akron, Ohio).

The properties of Tensile Strength, Tensile Elongation, Flexural Strength, Flexural Modulus, PGA compression, C.O.R., Shore D hardness on both the materials and the resulting ball may be conducted using the test methods as defined below.

Core or ball diameter may be determined by using standard linear calipers or size gauge.

Specific gravity may be determined by electronic densimeter using ASTM D-792.

Compression may be measured by applying a spring-loaded force to the golf ball center, golf ball core, or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be the same as an Atti compression of 60.

Initial velocity of a golf ball after impact with a golf club is governed by the United States Golf Association ("USGA"). The USGA requires that a regulation golf ball can have an initial velocity of no more than 250 feet per second±2% or 255 feet per second. The USGA initial velocity limit is related to the ultimate distance that a ball may travel (280 yards±6%), and is also related to the coefficient of restitution ("COR"). The coefficient of restitution is the ratio of the relative velocity between two objects after direct impact to the relative velocity before impact. As a result, the COR can vary from 0 to 1, with 1 being equivalent to a perfectly or completely elastic collision and 0 being equivalent to a perfectly plastic or completely inelastic collision. Since a ball's COR directly influences the ball's initial velocity after club collision and travel distance, golf ball manufacturers are interested in this characteristic for designing and testing golf balls. One conventional technique for measuring COR uses a golf ball or golf ball subassembly, air cannon, and a stationary steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/sec. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The coefficient of restitution can be calculated by the ratio of the outgoing transit time period to the incoming transit time period, $COR=T_{Out}/T_{in}$.

A "Mooney" viscosity is a unit used to measure the plasticity of raw or unvulcanized rubber. The plasticity in a Mooney unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Shore D material hardness may be measured in accordance with ASTM Test D2240. Hardness of a layer was measured on the ball, and if on the outer surface, perpendicular to a land area between the dimples. Unless a material hardness is specified all hard nesses are measured on the ball.

The ball performance may be determined using a Robot Driver Test, which utilized a commercial swing robot in conjunction with an optical system to measure ball speed, launch angle, and backspin after a golf ball is hit with a titanium driver or standard 8 iron as applicable. In this test, club is attached to a swing robot and the swing speed and power profile as well as tee location and club lie angle is setup to generate the following values using a Maxfli XS Tour golf ball as a reference:

Headspeed: 112 mph
Ballspeed: 160 mph
Launch Angle: 9 degrees
Backspin: 3200 rpm Then, the test ball is substituted for the reference ball and the corresponding values determined.

Shear cut resistance may be determined by examining the balls after they were impacted by a pitching wedge at controlled speed, classifying each numerically from 1 (excellent) to 5 (poor), and averaging the results for a given ball type. Three samples of each Example was used for this testing. Each ball was hit twice, to collect two impact data points per ball. Then, each ball was assigned two numerical scores-one for each impact-from 1 (no visible damage) to 5 (substantial material displaced). These scores were then averaged for each Example to produce the shear resistance numbers below. These numbers could then be directly compared with the corresponding number for a commercially available ball, the Taylor Made TP Black under the same test conditions, had a rating of 1.62.

Tensile Strength and Tensile Elongation may be measured in accordance with ASTM Test D 368.

Flexural Strength and Flexural Modulus may be measured in accordance with ASTM Test D 790.

Shore D hardness may be measured in accordance with ASTM Test D2240.

Melt flow index (12) may be measured in accordance with ASTM D-1238, Condition 230° C./2.16 kg.

VII. Additional Aspects

One aspect of the invention concerns a two-piece golf ball comprising a core and one cover layer; wherein the core has a PGA compression of less than 90, and the core/cover layer combined construct has a PGA compression of at least 30.

Another aspect of the invention concerns a three-piece golf ball comprising a core, an intermediate mantle layer, and a cover layer; wherein the core has a PGA compression of less than 80, and the core/intermediate mantle layer combined construct has a PGA compression of at least 30.

Another aspect of the invention concerns a golf ball comprising a core or core layers having diameter of from about 0.5 to about 1.62, preferably from about 0.7 to about 1.60, more preferably from about 1 to about 1.58, yet more preferably from about 1.20 to about 1.54, and most preferably from about 1.40 to about 1.50 in.

Another aspect of the invention concerns a golf ball having a PGA compression of less than about 140, preferably less than about 120, more preferably less than about 100, yet more preferably less than about 90, and most preferably less than about 80.

Another aspect of the invention concerns a golf ball comprising core layer(s) surrounding having a hardness difference between the center hardness and that of the next adjacent layer greater than 2, preferably greater than 5, most preferably greater than 10 units of Shore D.

Another aspect of the invention concerns a golf ball comprising core layer(s) having a hardness difference between the core layers greater than 2, preferably greater than 5, most preferably greater than 10 units of Shore D.

Another aspect of the invention concerns a golf ball having the hardness of the center and each sequential layer increasing progressively outwards from the center to outer core layer.

Another aspect of the invention concerns a golf ball having the hardness of the center and each sequential layer decreasing progressively inwards from the outer core layer to the center.

Another aspect of the invention concerns a golf ball comprising a one or more intermediate layers having thickness of about 0.01 to about 0.50 or about 0.01 to about 0.20, preferably from about 0.02 to about 0.30 or from about 0.02 to about 0.15, more preferably from about 0.03 to about 0.20 or from about 0.03 to about 0.10, and most preferably from about 0.03 to about 0.10 or about 0.03 to about 0.06 in.

Another aspect of the invention concerns a golf ball comprising a one or more intermediate layers having a hardness as measured on the ball of greater than about 25, preferably greater than about 30, more preferably greater than about 40, and most preferably greater than about 50, Shore D units.

Another aspect of the invention concerns a golf ball comprising a cover layer having a thickness of about 0.01 to about 0.10, preferably from about 0.02 to about 0.08, more preferably from about 0.03 to about 0.06 in.

Another aspect of the invention concerns a golf ball comprising a cover layer having a Shore D hardness as measured on the ball from about 35 to about 70, preferably from about 45 to about 70 or about 50 to about 70, more preferably from 47 to about 68 or about 45 to about 70, and most preferably from about 50 to about 65.

Another aspect of the invention concerns a golf ball having COR greater than about 0.700, preferably greater than about 0.760, more preferably greater than about 0.780, even more preferably greater than 0.790, even more preferably greater than 0.795, and more preferably greater than 0.800 at 125 ft/sec inbound velocity.

Another aspect of the invention concerns a multi-layered golf ball comprising a core or core layers, one or more intermediate mantle layer, one or more outer mantle layer; and a cover layer; wherein the core has a PGA compression of less than 70, and the core/intermediate mantle layer/outer mantle layer combined construct has a PGA compression of at least 30.

Another aspect of the invention concerns a golf ball comprising a core or core layers having diameter of from about 0.5 to about 1.62, preferably from about 0.7 to about 1.60, more preferably from about 1 to about 1.58, yet more preferably from about 1.20 to about 1.54, and most preferably from about 1.40 to about 1.50 in.

Another aspect of the invention concerns a golf ball having a PGA compression of less than about 140, preferably less than about 120, more preferably less than about 100, yet more preferably less than about 90, and most preferably less than about 80.

Another aspect of the invention concerns a golf ball comprising core layer(s) surrounding having a hardness difference between the center hardness and that of the next adjacent layer greater than 2, preferably greater than 5, most preferably greater than 10 units of Shore D.

Another aspect of the invention concerns a golf ball comprising core layer(s) having hardness difference between the core layers greater than 2, preferably greater than 5, most preferably greater than 10 units of Shore D.

Another aspect of the invention concerns a golf ball having the hardness of the center and each sequential layer increasing progressively outwards from the center to outer core layer.

Another aspect of the invention concerns a golf ball having the hardness of the center and each sequential layer decreasing progressively inwards from the outer core layer to the center.

Another aspect of the invention concerns a golf ball comprising a one or more intermediate layers having thickness of about 0.01 to about 0.50 or about 0.01 to about 0.20, preferably from about 0.02 to about 0.30 or from about 0.02 to about 0.15, more preferably from about 0.03 to about 0.20 or from about 0.03 to about 0.10, and most preferably from about 0.03 to about 0.10 or about 0.03 to about 0.06 in.

Another aspect of the invention concerns a golf ball comprising a one or more intermediate layers having a hardness as measured on the ball of greater than about 25, preferably greater than about 30, more preferably greater than about 40, and most preferably greater than about 50, Shore D units.

Another aspect of the invention concerns a golf ball comprising a cover layer having a thickness of about 0.01 to about 0.10, preferably from about 0.02 to about 0.08, more preferably from about 0.03 to about 0.06 in.

Another aspect of the invention concerns a golf ball comprising a cover layer having a Shore D hardness as measured on the ball from about 35 to about 70, preferably from about 45 to about 70 or about 50 to about 70, more preferably from 47 to about 68 or about 45 to about 70, and most preferably from about 50 to about 65.

Another aspect of the invention concerns a golf ball having COR greater than about 0.700, preferably greater than about 0.760, more preferably greater than about 0.780, even more preferably greater than 0.790, even more preferably greater than 0.795, and more preferably greater than 0.800 at 125 ft/sec inbound velocity.

Another aspect of the invention concerns a golf ball comprising (a) a core; (b) an inner mantle layer; (c) at least one intermediate mantle layer; (d) an outer mantle layer; and (e) at least one cover layer; wherein the core has a PGA compression of less than 70, and the core/inner mantle layer/intermediate mantle layer combined construct has a PGA compression of at least 30.

Another aspect of the invention concerns a golf ball wherein the core has a PGA compression of less than 60.

Another aspect of the invention concerns a golf ball wherein the core has a PGA compression of less than 40.

Another aspect of the invention concerns a golf ball wherein each of the mantle layers each have a thickness of less than 0.080 in.

Another aspect of the invention concerns a golf ball wherein the core/inner mantle layer/intermediate mantle layer combined construct has a PGA compression of at least 40.

Another aspect of the invention concerns a golf ball wherein the core/inner mantle layer/intermediate mantle layer combined construct has a PGA compression of at least 50.

Another aspect of the invention concerns a golf ball wherein the core/inner mantle layer/intermediate mantle layer combined construct has a PGA compression of 30 to 70.

Another aspect of the invention concerns a golf ball wherein the inner mantle layer, the intermediate mantle layer, the outer mantle layer, and the outer cover layer each individually comprises thermoset polyurethanes and thermoset polyureas, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, polyurethane ionomer, thermoplastic polyurethanes, thermoplastic polyureas, polyamides, copolyamides, polyesters, copolyesters, polycarbonates, polyolefins, halogenated polyolefins, halogenated polyethylenes, polyphenylene oxide, polyphenylene sulfide, diallyl phthalate polymer, polyimides, polyvinyl chloride, polyamide-ionomer, polyvinyl alcohol, polyarylate, polyacrylate, polyphenylene ether, impact-modified polyphenylene ether, polystyrene, high impact polystyrene, acrylonitrile-butadiene-styrene copolymer styrene-acrylonitrile (SAN), acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, a copolymer comprising at least one first co-monomer selected from butadiene, isoprene, ethylene or butylene and at least one second co-monomer selected from a (meth)acrylate or a vinyl arylene; or any and all combinations or mixtures thereof, a polyalkenamer rubber selected from the group consisting of polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber and any and all combinations of such materials.

Another aspect of the invention concerns a golf ball wherein the outer mantle layer has a material Shore D hardness of at least 55 and a material flexural modulus of at least 35 kpsi.

Another aspect of the invention concerns a golf ball wherein each of (a), (b), (c) and (d) has a Shore D hardness and the Shore D hardness of each of (a), (b), (c) and (d) increases from the core to the outer mantle layer.

Another aspect of the invention concerns a golf ball wherein each of (a), (b), (c) and (d) have a Shore D hardness and the Shore D hardness of each of (a), (b), (c) and (d) follows the relationships of (a)<(c)<(b)<(d), (a)<(b)<(d)<(c), (a)<(d)<(c)<(b), and (a)<(d)<(b)<(c).

Another aspect of the invention concerns a golf ball comprising (a) a core material having a PGA compression of less than 70 and a material flexural modulus of less than 20 kpsi; (b) an inner mantle layer material; (c) at least one intermediate mantle layer material; (d) an outer mantle layer material; and (e) at least one cover layer material; wherein the material of each of (a), (b), (c) and (d) have a material flexural modulus and the material flexural modulus of each of (a), (b), (c) and (d) increases from the core material to the outer mantle layer material such that each successive layer between the core material and the outer mantle layer material has a flexural modulus that is greater relative to the immediately adjacent inner layer material.

Another aspect of the invention concerns a golf ball wherein each of (a), (b), (c) and (d) have a flexural modulus and the flexural modulus of each of (a), (b), (c) and (d) follows the relationships of (a)<(c)<(b)<(d), (a)<(b)<(d)<(c), (a)<(d)<(c)<(b), and (a)<(d)<(b)<(c).

Another aspect of the invention concerns a golf ball wherein the core has a PGA compression of less than 40.

Another aspect of the invention concerns a golf ball wherein each of the mantle layers each has a thickness of less than 0.075 in.

Another aspect of the invention concerns a golf ball wherein the inner mantle layer has a material flexural modulus of 2 to 35 kpsi.

Another aspect of the invention concerns a golf ball wherein the intermediate mantle layer has a material flexural modulus of 10 to 50 kpsi.

Another aspect of the invention concerns a golf ball wherein the outer mantle layer has a material flexural modulus of 30 to 110 kpsi.

Another aspect of the invention concerns a golf ball wherein the core material has a flexural modulus of less than 10 kpsi and a PGA compression of less than 40.

Another aspect of the invention concerns a golf ball wherein the inner mantle layer, the intermediate mantle layer, the outer mantle layer, and the outer cover layer each individually comprises a thermoset polyurethanes and thermoset polyureas, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, polyurethane ionomer, thermoplastic polyurethanes, thermoplastic polyureas, polyamides, copolyamides, polyesters, copolyesters, polycarbonates, polyolefins, halogenated polyolefins, halogenated polyethylenes, polyphenylene oxide, polyphenylene sulfide, diallyl phthalate polymer, polyimides, polyvinyl chloride, polyamide-ionomer, polyvinyl alcohol, polyarylate, polyacrylate, polyphenylene ether, impact-modified polyphenylene ether, polystyrene, high impact polystyrene, acrylonitrile-butadiene-styrene copolymer styrene-acrylonitrile (SAN), acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, a copolymer comprising at least one first co-monomer selected from butadiene, isoprene, ethylene or butylene and at least one second co-monomer selected from a (meth)acrylate or a vinyl arylene; or any and all combinations or mixtures thereof, a polyalkenamer rubber selected from the group consisting of polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber and any and all combinations of such materials.

Another aspect of the invention concerns a golf ball wherein the outer mantle layer has a material Shore D hardness of at least 55 and a flexural modulus of at least 55 kpsi.

Another aspect of the invention concerns a golf ball wherein each successive layer between the core material and the outer mantle layer material has a flexural modulus that is greater by at least 3 kpsi relative to the immediately adjacent inner layer material.

Another aspect of the invention concerns a five-piece comprising: (a) a core material having a flexural modulus of less than 15 kpsi; (b) an inner mantle layer material adjacent to the core material, wherein the inner mantle layer material has a flexural modulus of 2-35 kpsi; (c) an intermediate mantle layer material adjacent to the inner mantle layer material, wherein the intermediate mantle layer material has a flexural modulus of 10-50 kpsi; (d) an outer mantle layer material adjacent to the intermediate mantle layer material, wherein the outer mantle layer material has a flexural modulus of 20-110 kpsi; and (e) an outer cover layer material.

Another aspect of the invention concerns a golf ball wherein the core material has a flexural modulus of less than 8 kpsi, the inner mantle layer material has a flexural modulus of 5-25 kpsi, the intermediate mantle layer material has a flexural modulus of 15-45 kpsi, and the outer mantle layer has a flexural modulus of 35-80 kpsi.

Another aspect of the invention concerns a golf ball wherein there is an increasing material Shore D hardness from the core material to the outer mantle layer material, and an increasing flexural modulus from the core material to the outer mantle layer material.

Another aspect of the invention concerns a golf ball wherein the Shore D hardness and the flexural modulus of each of (a), (b), (c) and (d) follows the relationships of (a)<(c)<(b)<(d), (a)<(b)<(d)<(c), (a)<(d)<(c)<(b), and (a)<(d)<(b)<(c) 10.

Another aspect of the invention concerns a golf ball wherein the core material has a PGA compression of less than 50.

Another aspect of the invention concerns a golf ball wherein each of the mantle layers each has a thickness of less than 0.080 in.

Another aspect of the invention concerns a golf ball wherein the inner mantle layer, the intermediate mantle layer, the outer mantle layer, and the outer cover layer each individually comprises a thermoset polyurethanes and thermoset polyureas, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, polyurethane ionomer, thermoplastic polyurethanes, thermoplastic polyureas, polyamides, copolyamides, polyesters, copolyesters, polycarbonates, polyolefins, halogenated polyolefins, halogenated polyethylenes, polyphenylene oxide, polyphenylene sulfide, diallyl phthalate polymer, polyimides, polyvinyl chloride, polyamide-ionomer, polyvinyl alcohol, polyarylate, polyacrylate, polyphenylene ether, impact-modified polyphenylene ether, polystyrene, high impact polystyrene, acrylonitrile-butadiene-styrene copolymer styrene-acrylonitrile (SAN), acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, a copolymer comprising at least one first co-monomer selected from butadiene, isoprene, ethylene or butylene and at least one second co-monomer selected from a (meth)acrylate or a vinyl arylene; or any and all combinations or mixtures thereof, a polyalkenamer rubber selected from the group consisting of polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber and any and all combinations of such materials.

Another aspect of the invention concerns a golf ball wherein the outer mantle layer has a material Shore D hardness of at least 55 and a flexural modulus of at least 35 kpsi.

Another aspect of the invention concerns a golf ball wherein the outer mantle layer material has a flexural modulus of 30-80 kpsi.

Another aspect of the invention concerns a golf ball comprising: (a) a core having a PGA compression of less than 40; (b) an inner mantle layer; (c) an intermediate mantle layer; (d) an outer mantle layer; and (e) an outer cover layer; wherein the golf ball has sufficient impact durability and a golf ball frequency of <4000 Hz.

Another aspect of the invention concerns a golf ball wherein the golf ball frequency is less than 3400 Hz.

Another aspect of the invention concerns a golf ball wherein the golf ball has a sound pressure level, S, of less than 81 dB.

Another aspect of the invention concerns a golf ball wherein the core comprises polybutadiene; the inner mantle layer and the intermediate mantle layer each individually comprise a unimodal ionomer; a bimodal ionomer; a modified unimodal ionomer; a modified bimodal ionomer; a thermoset polyurethane; a polyester elastomer; a copolymer comprising at least one first co-monomer selected from butadiene, isoprene, ethylene, propylene or butylene and at least one second co-monomer selected from a (meth)acrylate or a vinyl arylene; a polyalkenamer; or any and all combinations or mixtures thereof; the outer mantle layer comprises a copolymer of ethylene and (meth)acrylic acid partially neutralized with a metal selected from the group consisting of lithium, sodium, potassium, magnesium, calcium, barium, lead, tin, zinc, aluminum or a combination thereof; or a blend of a polyamide and at least one maleic anhydride grafted polyolefin; and the outer cover layer comprises a thermoset polyurethane; a thermoset polyurea; a polymer blend composition formed from a copolymer of ethylene and carboxylic acid as Component A, a hydroxyl-modified block copolymer of styrene and isoprene as Component B, and a metal cation as Component C; or a polymer blend composition formed from a copolymer of ethylene and carboxylic acid as Component A, a styrene-(ethylene-butylene)-styrene block copolymer as Component B, and a metal cation as Component C.

Another aspect of the invention concerns a golf ball wherein the polybutadiene of the core is obtained via a lanthanum rare earth catalyst.

Another aspect of the invention concerns a golf ball wherein the polybutadiene of the core further comprises a pyridine peptizer that also includes a chlorine functional group and a thiol functional group.

Another aspect of the invention concerns a golf ball wherein the inner mantle layer and the intermediate mantle layer each individually comprise polyoctenamer; a hydroxyl-modified block copolymer of styrene and isoprene; a high acid content modified ionomers; or a mixture thereof.

Another aspect of the invention concerns a golf ball wherein the core comprises polybutadiene; the inner mantle layer and the intermediate mantle layer each individually comprise a unimodal ionomer; a bimodal ionomer; a modified unimodal ionomer; a modified bimodal ionomer; a thermoset polyurethane; a polyester elastomer; a copolymer comprising at least one first co-monomer selected from butadiene, isoprene, ethylene, propylene or butylene and at least one second co-monomer selected from a (meth)acrylate or a vinyl arylene; a polyalkenamer; or any and all combinations or mixtures thereof; the outer mantle layer comprises a copolymer of ethylene and (meth)acrylic acid partially neutralized with a metal selected from the group consisting of lithium, sodium, potassium, magnesium, calcium, barium, lead, tin, zinc, aluminum or a combination thereof; or a blend of a polyamide and at least one maleic anhydride grafted polyolefin; and the outer cover layer comprises a thermoset polyurethane; a thermoset polyurea; a polymer blend composition formed from a copolymer of ethylene and carboxylic acid as Component A, a styrene-(ethylene-butylene)-styrene block copolymer as Component B, and a metal cation as Component C.

We claim:

1. A golf ball, comprising:

a core comprising a center and a peptizer;

an outer cover layer; and optionally one or more intermediate layers, wherein at least one or more of the core, outer cover layer, or one or more intermediate layers if present, comprises a sulfonated polyisoprene ionomer having the general formula

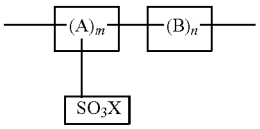

where A is an isoprene repeating unit having, prior to reaction with a sulfonate moiety, a formula—($CH_2$—C($CH_3$)=CH—$CH_2$)—, B is the isoprene repeating unit or other monomer repeating unit, m is greater than 10, and n is greater than 2, and X is an ammonium cation having the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic, an aromatic moiety, and any and all combinations thereof.

2. The golf ball of claim 1 wherein the core comprises the sulfonated polyisoprene ionomer and the outer cover layer comprises a polymer selected from the group consisting of thermoset polyurethanes, thermoset polyureas, thermoplastic polyurethanes, thermoplastic polyureas, ionomers, styrenic block copolymers, ethylene/(meth)acrylic acid copolymers, or ethylene/(meth)acrylic acid/alkyl (meth)acrylate terpolymers, a unimodal ionomer, a bimodal ionomer, a modified unimodal ionomer, a modified bimodal ionomer, and any and all combinations thereof.

3. The golf ball of claim 1 wherein the one or more intermediate layers comprises the sulfonated polyisoprene ionomer, and the outer cover layer comprises a polymer selected from the group consisting of thermoset polyurethanes, thermoset polyureas, thermoplastic polyurethanes, thermoplastic polyureas, ionomers, styrenic block copolymers, ethylene/(meth)acrylic acid copolymers, or ethylene/(meth)acrylic acid/alkyl (meth)acrylate terpolymers, a unimodal ionomer, a bimodal ionomer, a modified unimodal ionomer, a modified bimodal ionomer and any and all combinations thereof.

4. The golf ball of claim 1 wherein the outer cover layer comprises the sulfonated polyisoprene ionomer.

5. The golf ball of claim 1, wherein the outer cover layer comprises a blend composition comprising one or more ionomers blended with:

one or more triblock copolymers;

one or more hydrogenation products of the triblock copolymers; or one or more hydrogenated diene block copolymers.

6. The golf ball of claim 1, wherein the outer cover layer comprises the reaction product of:

at least one component A comprising a monomer, oligomer, or prepolymer, or polymer comprising at least 5% by weight of at least one type of functional group;

at least one component B comprising a monomer, oligomer, prepolymer, or polymer comprising less by weight of anionic functional groups than the weight percentage of anionic functional groups of the at least one component A;

at least one component C comprising a metal cation; and wherein the reaction product comprises a pseudo-crosslinked network of the at least one component A in the presence of the at least one component B.

7. The golf ball of claim 1, wherein one of the intermediate layers comprises a polyalkenamer rubber selected from the group consisting of polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber and any and all combinations thereof.

8. A 5-piece golf ball according to claim 1.

9. The golf ball of claim 1, wherein the ammonium cation is selected from methylammonium, dimethylammonium, trimethylammonium, ethylammonium, diethylammonium, triethylammonium, and trihydroxymethylamine.

10. The golf ball of claim 1, wherein the ammonium cation is an alcohol or alkoxy substituted ammonium cation derived from dihydroxymethylamine, monohydroxymethylamine, monoethanolammonium, di-ethanolammonium, triethanolammonium, N-methylmonoethanol-ammonium, N-methyldiethanolammonium, monopropanolammonium, dipropanolammonium and tripropanolammonium.

11. The golf ball of claim 1, wherein the core has a PGA compression of less than about 80.

12. The golf ball of claim 1, wherein the golf ball has a COR value of about 0.795 at 125 ft/sec inbound velocity.

13. The golf ball of claim 1, wherein the golf ball has a COR value of about 0.800 at 125 ft/sec inbound velocity.

14. The golf ball of claim 1, wherein the core comprises a synthetic rubber component and the peptizer is provided in an amount ranging from about 0.01 to about 10 parts by weight per 100 parts by weight of the synthetic rubber component.

15. The golf ball of claim 1, wherein the core comprises a synthetic rubber component and the peptizer is provided in an amount ranging from about 0.15 to about 5 parts by weight per 100 parts by weight of the synthetic rubber component.

16. The golf ball of claim 1, wherein the peptizer is a heteroaryl or heterocyclic compound having at least one heteroatom.

17. The golf ball of claim 1, wherein the peptizer component is 2,3,5,6-tetrachloro-4-pyridinethiol.

18. A golf ball, comprising:

a core comprising a center and a peptizer selected from a heteroaryl or heterocyclic compound having at least one heteroatom;

an outer cover layer; and optionally one or more intermediate layers, wherein at least one or more of the core, outer cover layer, or one or more intermediate layers if present, comprises a sulfonated polyisoprene ionomer having a PGA compression value of from about 30 to about 200, when formed into a sphere, and a general formula

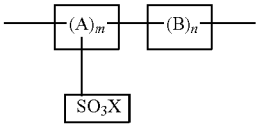

where A is an isoprene repeating unit having, prior to reaction with a sulfonate moiety, a formula—($CH_2$—C($CH_3$)=CH—$CH_2$)—, B is the isoprene repeating unit or other monomer repeating unit, m is greater than 10, and n is greater than 2, and each X independently is selected from an ammonium cation having the general formula $[NR^1R^2R^3R^4]^+$ where $R^1$, $R^2$, $R^3$ and $R^4$ are selected from the group consisting of hydrogen, a $C_1$-$C_{20}$ aliphatic, cycloaliphatic, an aromatic moiety, and any and all combinations thereof.

19. A golf ball, comprising:

a core comprising a center and 2,3,5,6-tetrachloro-4-pyridinethiol;

optionally one or more intermediate layers; and an outer cover layer comprising a sulfonated polyisoprene ionomer having a PGA compression value of from about 30 to about 200, when formed into a sphere, and a general formula

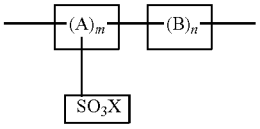

where A is an isoprene repeating unit having, prior to reaction with a sulfonate moiety, a formula—($CH_2$—C($CH_3$)=CH—$CH_2$)—, B is the isoprene repeating unit or other monomer repeating unit, m is greater than 10, and n is greater than 2, and each X independently is selected from an ammonium cation selected from methylammonium, dimethylammonium, trimethylammonium, ethylammonium, diethylammonium, triethylammonium, trihydroxymethylamine, an alcohol or alkoxy substituted ammonium cation derived from dihydroxymethylamine, monohydroxymethylamine, monoethanolammonium, di-ethanolammonium, triethanolammonium, N-methylmonoethanol-ammonium, N-methyldiethanolammonium, monopropanolammonium, dipropanolammonium and tripropanolammonium.

* * * * *